US006432599B1

(12) United States Patent
Yuasa et al.

(10) Patent No.: US 6,432,599 B1
(45) Date of Patent: Aug. 13, 2002

(54) TONER AND METHOD FOR PRODUCING THE SAME

(75) Inventors: Yasuhito Yuasa; Noriaki Hirota; Masahisa Maeda, all of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/976,884

(22) Filed: Oct. 12, 2001

Related U.S. Application Data

(63) Continuation-in-part of application No. 09/754,157, filed on Jan. 4, 2001, now Pat. No. 6,326,116, which is a continuation of application No. 09/337,843, filed on Jun. 21, 1999, now abandoned.

(30) Foreign Application Priority Data

| | | |
|---|---|---|
| Jun. 25, 1998 | (JP) | 10-178545 |
| Aug. 7, 1998 | (JP) | 10-223940 |
| Aug. 7, 1998 | (JP) | 10-223941 |
| Aug. 7, 1998 | (JP) | 10-223942 |
| Aug. 20, 1998 | (JP) | 10-233948 |

(51) Int. Cl.[7] ..... G03G 9/097

(52) U.S. Cl. ..... 430/108.4; 430/108.6; 430/108.7; 430/111.4

(58) Field of Search ..... 430/108.4, 108.6, 430/108.7, 111.4

(56) References Cited

U.S. PATENT DOCUMENTS

| | | | | |
|---|---|---|---|---|
| 4,883,736 | A | 11/1989 | Hoffend et al. | |
| 5,072,244 | A | 12/1991 | Aoki et al. | |
| 5,124,226 | A | 6/1992 | Yabuuchi et al. | |
| 5,422,218 | A | 6/1995 | Tong | |
| 5,529,873 | A | 6/1996 | Chiba et al. | |
| 5,614,347 | A | 3/1997 | Aoki | |
| 5,840,460 | A | 11/1998 | Machida et al. | |
| 5,981,132 | A | 11/1999 | Kurose et al. | |
| 6,087,059 | A | 7/2000 | Duggan et al. | |
| 6,270,937 | B2 * | 8/2001 | Yuasa et al. | 430/108.7 |
| 6,326,116 | B2 * | 12/2001 | Yuasa et al. | 430/111.32 |

FOREIGN PATENT DOCUMENTS

| | | |
|---|---|---|
| EP | 0 417 016 | 3/1991 |
| GB | 2 078 385 | 1/1982 |
| JP | 58-60754 | 4/1983 |
| JP | 58-223155 | 12/1983 |
| JP | 59-148067 | 8/1984 |
| JP | 1-252982 | 10/1989 |
| JP | 2-212867 | 8/1990 |
| JP | 4-190240 | 7/1992 |

* cited by examiner

*Primary Examiner*—John Goodrow
(74) *Attorney, Agent, or Firm*—Merchant & Gould PC

(57) ABSTRACT

The present invention provides a toner comprising a binding resin, a colorant, and an ester based wax having an iodine value of not more than 25 and a saponification value of 30 to 300 (for example, at least one selected from the group consisting of meadowfoam oil and derivatives thereof and jojoba oil and derivatives thereof) and a method for producing the same. The present invention also provides a toner comprising silica fine powder containing a component having a polydimethyl siloxane skeleton extracted by an organic solvent at a content of not more than 2.5 wt %, and a method for producing the same. This stabilizes the chargeability and flowability of the toner during long period use, and reduces the filming on a photoconductive member or a transfer medium, Moreover, toner that provides good fixability, anti-offset properties, waste toner recycle properties, and transfer efficiency can be obtained with good reproducibility.

6 Claims, 5 Drawing Sheets

TONER AND METHOD FOR PRODUCING THE SAME

This application is a Continuation-in-Part of application Ser. No. 09/754,157, filed Jan. 4, 2001, now U.S. Pat. No. 6,326,116 which is a Continuation of application Ser. No. 09/337,843, filed on Jun. 21, 1999 now abandoned.

BACKGROUND OF THE INVENTION

1. Field of the Invention

The present invention relates to toner used for copiers, laser beam printers (LBP), plain paper facsimiles, color electrophotography (PPC), color LBPs or color facsimiles and a method for producing the same.

2. Description of the Prior Art

Recently, electrophotographic apparatuses, which commonly were used in offices, have been used increasingly for personal purposes, so that technologies to achieve compact or maintenance-free electrophotographic apparatuses are required. To meet this end, it is necessary to improve maintenance properties such as recycling of waste toner and reducing the emission of ozone.

It is well-know that toner for electrostatic charge development used in an electrophotographic method generally includes a resin component, a coloring component including a pigment or a dye, a plasticizer, a charge controlling agent, and an additive, if necessary, such as a releasing agent. As the resin component, natural or synthetic resin is used alone or in combination. An additive is pre-mixed in an appropriate ratio and the resulting mixture is heated and kneaded by thermal melting, and pulverized by an air stream collision board system, and fine powder is classified to complete a toner base. Thereafter, an external additive is added to the toner base externally so as to complete the toner. The single component development typically uses toner only, and in the two component development system, the developer material includes toner and carrier comprising magnetic granules.

For color copiers, a photoconductive member is charged by corona discharge with a charger, and then is exposed to optical signals for latent images for each color to form electrostatic latent images. The latent images are developed by a first color toner, e.g., yellow toner, to form visible images. Thereafter, a transfer material charged with a polarity reverse to that of the charged yellow toner is contacted with the photoconductive member so that the yellow toner images formed on the photoconductive member are transferred thereto. The photoconductive member is cleaned by removing residual toner that has not been transferred, and the development and transfer of the first color toner ends with discharging the photoconductive member. Thereafter, the same operations as those for the yellow toner are repeated for toners for other colors such as magenta and cyan. The toner images of the colors are superimposed on the transfer material so as to form color images. Then, the superimposed toner images are transferred to a transfer paper charged with a polarity reverse to that of the toner, and fixed. Thus, the copying operation ends.

As a method for forming color images, a transfer drum method and a successive superimposition method generally are used. In the transfer drum method, toner images for each color are formed on a single photoconductive member one after another, and a transfer material wound on a transfer drum is opposed to the photoconductive member repeatedly by rotating the drum so that the toner images for each color formed sequentially are superimposed and transferred to the transfer material. In the successive superimposition method, a plurality of image formation sections are provided, and toner images for each color are transferred to a transfer material conveyed by a belt sequentially while moving the image formation sections so that the color images are superimposed. One example using the transfer drum method is a color image formation apparatus disclosed in Japanese Laid-Open Patent Publication (Tokkai-Hei) No. 1-252982. One example of a color image formation apparatus using the successive transfer method is disclosed in Japanese Laid-Open Patent Publication (Tokkai-Hei) No. 1-250970. In this conventional example, four image formation stations, each of which includes a photoconductive member, optical scanning means or the like, are arranged to form images for four colors. A paper conveyed by a belt passes below each photoconductive member so that color toner images are superimposed. As another method for forming color images by superimposing toner images for different colors on a transfer material, Japanese Laid-Open Patent Publication (Tokkai-Hei) No. 2-212867 discloses the following method. Toner images for each color formed on a photoconductive member sequentially are superimposed on an intermediate transfer material, and then the toner images on the intermediate transfer material are transferred to a transfer paper collectively.

Further, Japanese Laid-Open Patent Publication (Tokkai-Sho) No. 59-148067 discloses toner using as a resin an unsaturated ethylene based polymer including a low molecular weight and a high molecular weight portion, where the peak value of the low molecular weight and Mw/Mn are defined, and containing polyolefin having a specific softening point. This disclosure is intended to provide fixability and an anti-offset property. Japanese Laid-Open Patent Publication (Tokkai-Sho) No. 56-158340 discloses toner comprising a resin including a specific low molecular weight polymer component and a specific high molecular weight polymer component as the main component. The low molecular weight component is used to provide fixability, and the high molecular weight component is used to provide the anti-offset property. Further, Japanese Laid-Open Patent Publication (Tokkai-Sho) No. 58-223155 discloses toner having containing a resin including an unsaturated ethylene based polymer having the local maximum in molecular weight ranges of 1000 to 10000 and 200000 to 1000000 and Mw/Mn of 10 to 40, and a polyolefin having a specific softening point. The low molecular weight component is used to provide fixability, and the high molecular weight component and the polyolefin are used to provide the anti-offset property.

However, when the melt viscosity of a binding resin is reduced or a low molecular weight resin is used in order to raise the fixing strength with high-speed machines, the so-called "spent", which is caused by toner adhering to carriers, may occur during long term use in the case of two component development. In the case of the single component development, the toner is likely to adhere to a doctor blade or a development sleeve, so that the stress resistance property of the toner deteriorates. When the toner is used in a low-speed machine, offset caused by toner adhering to a heat roller may occur at the time of fixing. Further, blocking caused by toner particles fused with each other may occur during long period storage.

On the other hand, the successive transfer system includes image formation positions corresponding in number to the number of colors, and a paper is allowed to pass by the image formation positions one after another. Therefore, a transfer drum is not required. However, this system requires a plurality of latent image formation means, such as laser optical systems, for forming latent images on the photoconductive member corresponding in number to the number of colors. This complicates the structure and makes the apparatus expensive. Moreover, since there are a plurality of image formation positions, positions of portions where images for different colors are formed may not match each other, the rotation axis may be off center, or the parallelism of the portions may not match. These factors prevent the colors from being placed in intended positions and make it difficult to obtain high quality images stably. In particular, it is necessary to register the latent images for different colors precisely by the latent image formation means. As shown in Japanese Laid-Open Patent Publication (Tokkai-Hei) No. 1-250970, considerable efforts and a complicated configuration for an image exposure system, which is a latent formation means, are required.

Furthermore, in the example of Japanese Laid-Open Patent Publication (Tokkai-Hei) No. 2-212867 employing an intermediate transfer material, toner images for all colors are formed on one and the same photoconductive member. Therefore, a plurality of developing devices are required to be provided around the single photoconductive member, and therefore the photoconductive member should be large. Furthermore, the photoconductive member is belt-shaped, which is difficult to handle. Moreover, at the time of replacement of each development device for maintenance, matching adjustment is required, or at the time of replacement of the photoconductive member, position adjustment relative to each development device is required. Thus, the maintenance of the development device for each color and the photoconductive member is difficult.

Furthermore, a process for producing toner includes a pre-blending treatment, a kneading treatment, a pulverization treatment, a classification treatment and an external addition treatment. The classification treatment is intended to classify toner powder so as to obtain a predetermined particle size distribution. In the current system, the toner powder that has been classified out is disposed of, because if the removed toner powder is used to be blended again, fog increases. Especially polypropylene or polyethylene wax, which is added to improve a releasing property, increases fog significantly. The reuse of the toner powder, which is generated in an amount of about 10 to 20 wt %, would result in more effective use of resources.

SUMMARY OF THE INVENTION

Therefore, with the foregoing in mind, it is a first object of the present invention to provide toner having improved dispersibility of an internal additive such as wax in a binding resin and uniform charge distribution, and a method for producing the same.

It is a second object of the present invention to provide toner for full color electrophotography that allows oilless fixation, that is, fixation without applying oil, and a method for producing the same.

It is a third object of the present invention to provide toner that improves the dispersibility of an additive without degrading resin characteristics even if a high functional binding resin is used, and maintains a stable development property, and to provide a method for producing the same.

It is a fourth object of the present invention to provide toner that can achieve both fixability and anti-offset properties when used in machines having widely different process speeds, and has excellent dispersibility and stable chargeability so that high quality images are reproduced, and to provide a method for producing the same.

It is a fifth object of the present invention to provide toner that prevents thinning-out or scattering during transfer in an electrophotographic method employing a conductive elastic roller or an intermediate transfer member and achieves a high transfer efficiency, and to provide a method for producing the same.

It is a sixth object of the present invention to provide toner that prevents filming on a photoconductive member and an intermediate transfer member, and a method for producing the same.

It is a seventh object of the present invention to provide toner that allows development with waste toner without reducing the charge amount and the flowability of a developer and without generating agglomerates, achieves a long life, and allows reduction of global environmental pollution and reuse of the resources, and to provide a method for producing the same.

It is an eighth object of the present invention to provide toner that provides stable images even if classified-out toner powder is reused in blending, and a method for producing the same.

A first toner of the present invention comprises a binding resin, a colorant, and an ester based wax having an iodine value of not more than 25 and a saponification value of 30 to 300.

It is preferable that the toner comprises 1 to 10 parts by weight of the colorant and 0.1 to 10 parts by weight of the ester based wax per 100 parts by weight of the binding resin.

It is preferable that the toner comprises 3 to 8 parts by weight of the colorant and 0.5 to 8 parts by weight of the ester based wax per 100 parts by weight of the binding resin.

It is preferable that the toner further comprises a polyolefin wax that is graft modified with unsaturated carboxylic acid and has an oxygen number of 6 to 200 mgKOH/g.

It is preferable that the toner comprises 0.1 to 10 parts by weight of the polyolefin wax per 100 parts by weight of the binding resin.

It is preferable that a melting point of the ester based wax according to the DSC method is 50 to 100° C.

It is preferable that a volume increase ratio of the ester based wax at a temperature equal to or more than the melting point is 2 to 30%.

It is preferable that a heating loss of the ester based wax at a temperature of 220° C. is not more than 8 wt %.

It is preferable that the binding resin is formed by adding the ester based wax to a solution, and removing a solvent.

It is preferable that the ester based wax is at least one substance selected from the group consisting of meadowfoam oil derivatives and jojoba oil derivatives.

It is preferable that the jojoba oil derivative is at least one selected from the group consisting of jojoba oil fatty acid, a metal salt of jojoba oil fatty acid, jojoba oil fatty acid ester, hydrogenated jojoba oil, jojoba oil amide, homojojoba oil amide, jojoba oil triester, maleic acid derivatives from epoxidized jojoba oil, and isocyanate polymer of jojoba oil fatty acid polyhydric alcohol ester.

It is preferable that the jojoba oil triester is obtained by epoxidizing jojoba oil, hydrating the resultant for ring-opening, and then effecting acylation.

It is preferable that the metal salt of jojoba oil fatty acid is at least one metal salt selected from the group consisting of sodium, potassium, calcium, magnesium, barium, zinc, lead, manganese, iron, nickel, cobalt, and aluminum.

It is preferable that the meadowfoam oil derivative is at least one selected from the group consisting of meadowfoam oil fatty acid, a metal salt of meadowfoam oil fatty acid, meadowfoam oil fatty acid ester, hydrogenated meadowfoam oil, meadowfoam oil amide, homomeadowfoam oil amide, meadowfoam oil triester, maleic acid derivatives of epoxidized meadowfoam oil, and isocyanate polymer of meadowfoam oil fatty acid polyhydric alcohol ester.

It is preferable that the meadowfoam oil triester is obtained by epoxidizing meadowfoam oil, hydrating the resultant product for ring-opening, and effecting acylation.

It is preferable that the metal salt of meadowfoam oil fatty acid is at least one metal salt selected from the group consisting of sodium, potassium, calcium, magnesium, barium, zinc, lead, manganese, iron, nickel, cobalt, and aluminum.

It is preferable that the toner further comprises an inorganic external additive.

It is preferable that the inorganic external additive is silica fine powder.

It is preferable that the silica fine powder is treated or coated with silicone oil.

It is preferable that the silica fine powder has a BET specific surface area by nitrogen adsorption of 30 to 350 $m^2/g$.

It is preferable that the silica fine powder has a weight average particle diameter of 5 to 100 nm.

It is preferable that the toner comprises 0.1 to 10 parts by weight of the inorganic external additive per 100 parts by weight of the binding resin.

It is preferable that the binding resin has a weight average molecular weigh Mw of the toner of 100000 to 600000, a ratio Mw/Mn of the weight average molecular weight Mw to a number average molecular weight Mn of 50 to 100, a ratio Mz/Mn of a Z average molecular weight Mz to the number average molecular weight Mn of 350 to 1200, and a 1/2 outflow temperature measured by a koka-type flow tester of 100 to 145° C.

It is preferable that the binding resin is polyester resin obtained by condensation polymerization between polycarboxylic acid or a lower alkyl ester thereof and polyhydric alcohol, having a weight average molecular weight Mw is 10000 to 300000, a ratio Mw/Mn of the weight average molecular weight Mw to a number average molecular weight Mn is 3 to 50, a ratio Mz/Mn of the Z average molecular weight Mz to the number average molecular weight Mn is 10 to 800, a 1/2 outflow temperature measured by a koka-type flow tester is 80 to 150° C., and an outflow start temperature is 80 to 120° C.

It is preferable that the binding resin comprises a copolymer obtained by copolymerizing at least a styrene based monomer and a monomer represented by Formula 1:

Formula 1

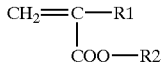

(where R1 is a hydrogen atom or a lower alkyl group having 1 to 3 carbon atoms, and R2 is a hydrogen atom, an alkyl group having 1 to 12 carbon atoms, a hydroxylalkyl group having 1 to 12 carbon atoms, or a vinylester group).

It is preferable that the binding resin comprises a copolymer obtained by copolymerizing at least a styrene based monomer and monomers represented by Formulae 2 and 3:

Formula 2

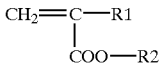

(where R1 is a hydrogen atom or a lower alkyl group having 1 to 3 carbon atoms, and R2 is a hydrogen atom, an alkyl group having 1 to 12 carbon atoms, a hydroxylalkyl group having 1 to 12 carbon atoms, or a vinylester group);

Formula 3

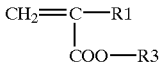

(where R1 is a hydrogen atom or a lower alkyl group having 1 to 3 carbon atoms, and R3 is an alkyl group having 16 to 25 carbon atoms).

It is preferable that the binding resin comprises a copolymer obtained by copolymerizing at least a styrene based monomer and monomers represented by Formulae 4 and 5:

Formula 4

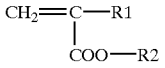

(where R1 is a hydrogen atom or a lower alkyl group having 1 to 3 carbon atoms, and R2 is a hydrogen atom, an alkyl group having 1 to 12 carbon atoms, a hydroxylalkyl group having 1 to 12 carbon atoms, or a vinylester group);

Formula 5

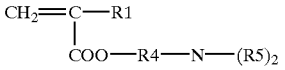

(where R1 is a hydrogen atom or a lower alkyl group having 1 to 3 carbon atoms, and R4 is $C_nH_{2n}$ (n: 1 to 5), and R5 is a lower alkyl group having 1 to 5 carbon atoms).

It is preferable that the toner further comprises a magnetic body in a toner base.

It is preferable that the magnetic body has an average particle size of 0.02 to 2.0 $\mu$m, a ratio D25/D75 of 25% residual diameter D25 to 75% residual diameter D75 of 1.3 to 1.7, a BET specific surface area by nitrogen adsorption of 0.5 to 80 $m^2/g$, an electrical resistance of $10^2$ to $10^{11}$ Ωcm, a bulk density of 0.3 to 0.9 g/cc and a compression ratio of 30 to 80%, a capacity of absorbing linseed oil in an amount of 10 to 30 ml/100 g, a remnant magnetization of 5 to 20 emu/g, and a saturation magnetization of 40 to 80 emu/g.

It is preferable that the magnetic body is treated with at least one coupling agent selected from the group consisting of a titanium based coupling agent, a silane based coupling agent, an epoxysilane coupling agent, an acrylsilane coupling agent, and an aminosilane coupling agent.

It is preferable that in the toner constituting a two component developer together with a carrier, the carrier has a volume resistance of $10^8$ to $10^{14}$ Ωcm, and has a coating layer of at least one resin selected from the group consisting of an acrylic based resin and a silicone based resin on a surface of magnetic core particles, and the magnetic core particles are at least one selected from the group consisting of Mn ferrite, Mn—Mg ferrite, and Li—Mn ferrite.

It is preferable that the inorganic external additive comprises silica and at least one substance selected from the group consisting of metal oxide fine powder and metal acid salt fine powder.

It is preferable that the metal acid salt fine powder comprises at least one selected from the group consisting of titanate based fine powder and zirconate based fine powder, each having an average particle size of 0.02 to 4 $\mu$m and a BET specific surface area by nitrogen adsorption of 0.1 to 100 $m^2/g$.

It is preferable that the metal acid salt fine powder is prepared by one method selected from the group consisting of a hydrothermal method or an oxalate thermal decomposition method.

It is preferable that the metal oxide fine powder comprises at least one selected from the group consisting of titanium oxide fine powder, aluminum oxide fine powder, strontium oxide fine powder, tin oxide fine powder, zirconium oxide fine powder, magnesium oxide fine powder, and indium oxide fine powder, each having an average particle size of 0.02 to 2 $\mu$m, a BET specific surface area by nitrogen adsorption of 0.1 to 100 $m^2/g$ and an electrical resistivity of not more than $10^9$ Ωcm.

It is preferable that the metal oxide fine powder is at least one fine powder selected from the group consisting of titanium oxide fine powder and silica oxide fine powder whose surface is coated with a mixture of tin oxide and antimony, each having a BET specific surface area by nitrogen adsorption of 1 to 200 $m^2/g$.

It is preferable that the metal oxide fine powder comprises a magnetic body having an average particle size of 0.02 to 2.0 $\mu$m, a ratio D25/D75 of 25% residual diameter D25 to 75% residual diameter D75 of 1.3 to 1.7, a BET specific surface area by nitrogen adsorption of 0.5 to 80 $m^2/g$, an electrical resistance of $10^2$ to $10^{11}$ Ωcm, a bulk density of 0.3 to 0.9 g/cc and a compression ratio of 30 to 80%, a capacity of absorbing linseed oil in an amount of 10 to 30 ml/100 g, a remnant magnetization of 5 to 20 emu/g, and a saturation magnetization of 40 to 80 emu/g.

A second toner of the present invention comprises silica fine powder, wherein the content of a component having a polydimethyl siloxane skeleton in the silica fine powder that is extracted by an organic solvent is not more than 2.5 wt %.

It is preferable that the silica has a BET specific surface area by nitrogen adsorption of 30 to 350 $m^2/g$, and is treated or coated with one silicone oil selected from the group consisting of dimethyl silicone oil, methyl phenyl silicone oil, alkyl modified silicone oil, fluorine modified silicone oil, amino modified silicone oil, and epoxy modified silicone oil.

It is preferable that the toner comprises a toner base including a binding resin and a colorant.

It is preferable that the content of a component having a polydimethyl siloxane skeleton in the toner that is extracted by an organic solvent is not more than 0.09 wt %.

It is preferable that the binding resin has a weight average molecular weigh Mw in a molecular weight distribution of 100000 to 600000, a ratio Mw/Mn of the weight average molecular weight Mw to a number average molecular weight Mn of 50 to 100, a ratio Mz/Mn of a Z average molecular weight Mz to the number average molecular weight Mn of 350 to 1200, and a 1/2 outflow temperature measured by a koka-type flow tester of 100 to 145° C.

It is preferable that the binding resin comprises a copolymer obtained by copolymerizing at least a styrene based monomer and a monomer represented by Formula 6:

Formula 6

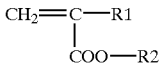

(where R1 is a hydrogen atom or a lower alkyl group having 1 to 3 carbon atoms, and R2 is a hydrogen atom, an alkyl group having 1 to 12 carbon atoms, a hydroxylalkyl group having 1 to 12 carbon atoms, or a vinylester group).

It is preferable that the binding resin comprises a copolymer obtained by copolymerizing at least a styrene based monomer and monomers represented by Formulae 7 and 8:

Formula 7

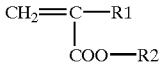

(where R1 is a hydrogen atom or a lower alkyl group having 1 to 3 carbon atoms, and R2 is a hydrogen atom, an alkyl group having 1 to 12 carbon atoms, a hydroxylalkyl group having 1 to 12 carbon atoms, or a vinylester group);

Formula 8

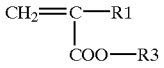

(where R1 is a hydrogen atom or a lower alkyl group having 1 to 3 carbon atoms, and R3 is an alkyl group having 16 to 25 carbon atoms).

It is preferable that the binding resin comprises a copolymer obtained by copolymerizing at least a styrene based monomer and monomers represented by Formulae 9 and 10:

Formula 9

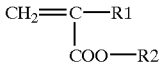

(where R1 is a hydrogen atom or a lower alkyl group having 1 to 3 carbon atoms, and R2 is a hydrogen atom, an alkyl group having 1 to 12 carbon atoms, a hydroxylalkyl group having 1 to 12 carbon atoms, or a vinylester group);

Formula 10

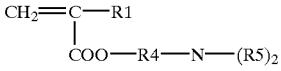

(where R1 is a hydrogen atom or a lower alkyl group having 1 to 3 carbon atoms, and R4 is $C_nH_{2n}$ (n: 1 to 5), and R5 is a lower alkyl group having 1 to 5 carbon atoms).

A first method for producing a toner of the present invention comprises the steps of pre-blending a toner base component material comprising at least a binding resin and a colorant, kneading the toner base, pulverizing the same, classifying the produced colored particles to cut off powder toner for a predetermined particle size distribution, wherein an ester based wax is added to the binding resin before the pre-blending step.

It is preferable that in the method, the ester based wax is at least one substance selected from the group consisting of meadowfoam oil derivatives and jojoba oil derivatives.

It is preferable that in the method, the binding resin comprises a main component obtained by adding at least one compound selected from the group consisting of meadowfoam oil derivatives and jojoba oil derivatives to a binding resin solution, and removing a solvent.

It is preferable that in the method, the binding resin is polyester resin obtained by condensation polymerization between polycarboxylic acid or a lower alkyl ester thereof and polyhydric alcohol, having a weight average molecular weight Mw of 10000 to 300000, a ratio Mw/Mn of the weight average molecular weight Mw to a number average molecular weight Mn of 3 to 50, a ratio Mz/Mn of the Z average molecular weight Mz to the number average molecular weight Mn of 10 to 800, a 1/2 outflow temperature measured by a koka-type flow tester of 80 to 150° C., and an outflow start temperature of 80 to 120° C.

It is preferable that in the method, the powder toner that is cut off by the classification step is returned to the pre-blending step again, and reused to be pre-blended with the toner base component material.

It is preferable that a ratio of the powder toner that is cut off by the classification to the toner base component material is 2:98 to 40:60.

It is preferable that in the method, the toner comprises an ester based wax having an iodine value of not more than 25 and a saponification value of 30 to 300.

It is preferable that in the method, the toner comprises a polyolefin wax that is graft modified with unsaturated carboxylic acid and has an oxygen number of 6 to 200 mgKOH/g.

A second method for producing a toner of the present invention comprises silica fine powder, wherein the content of a component having a polydimethyl siloxane skeleton in the silica fine powder that is extracted by an organic solvent is not more than 2.5 wt %, and a toner base is subjected to a melting treatment by hot air, and then an external additive is added and mixed with the toner base.

It is preferable that in the method, at least one substance selected from the group consisting of hydrophobic silica, metal oxide fine powder and metal acid salt fine powder is mixed and adhered to the toner base, and then a surface improvement treatment is performed by hot air.

It is preferable that in the method, at least one substance selected from the group consisting of hydrophobic silica, metal oxide fine powder and metal acid salt fine powder is mixed and adhered to the toner base, and then a surface improvement treatment is performed with hot air, and the method further comprises the step of performing a treatment of external addition of at least one substance selected from the group consisting of hydrophobic silica, metal oxide fine powder and metal acid salt fine powder.

As described above, according to the present invention, the toner includes meadowfoam oil derivatives and/or jojoba oil derivatives, and silica fine powder whose content of a component having a polydimethyl siloxane skeleton is not more than 2.5 wt % is added externally to the toner base. Therefore, this embodiment stabilizes the chargeability and the flowability of the toner when used for a long period and eliminates the filming on a photoconductive member or a transfer medium. Moreover, the toner has a good fixing property and anti-offset property and allows recycling of waste toner and efficient transfer, and such toner can be obtained with high reproducibility.

Furthermore, the toner of the present invention can be used suitably in the following electrophotographic method. A plurality of movable image formation units for forming toner images for different colors are provided to form a circle, forming a group of image formation units, and all the image formation units move while rotating as one unit. This structure can achieve high density and low background fog and prevent the filming on the photoconductive member. Furthermore, when the toner of the present invention is used in an electrophotographic apparatus including a transfer system employing an intermediate transfer member, thinning-out or scattering can be prevented so as to achieve high transfer efficiency. Furthermore, in fixing four color toners, the toner of the present invention has good fixability, anti-offset properties and glossiness without oil.

These and other advantages of the present invention will become apparent to those skilled in the art upon reading and understanding the following detailed description with reference to the accompanying figures.

DESCRIPTION OF THE PREFERRED EMBODIMENTS

Figure 1:
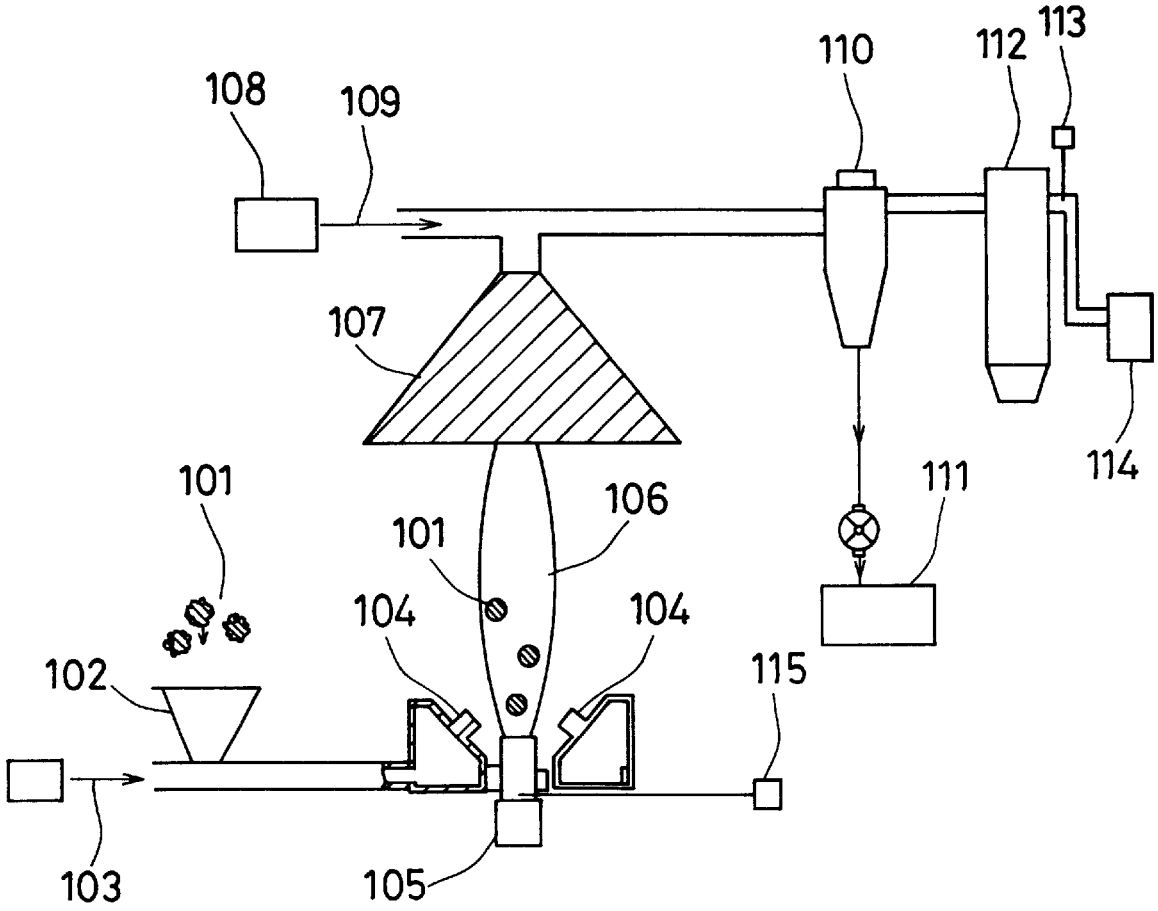
FIG. 1 is a schematic cross-sectional drawing of an example of a surface-improvement treatment apparatus used for toner of the present invention.

In the present invention, ester based wax is added to a binding resin together with a colorant. The ester based wax serves as a fixing assistant for improving the fixability to strengthen the adhesion with a paper. In addition, its presence serves to reduce frictional resistance on the surface of the images on a paper, and prevents peeling of the toner from the paper due to scrubbing, thus improving the fixability. Moreover, the anti-offset property can be improved, and the stability can be maintained during storage.

Ester based wax having an ester bond obtained by a reaction between a higher fatty acid and a higher alcohol is used suitably. Preferably, the ester based wax has an iodine value of not more than 25, a saponification value of 30 to 300, and a melting point according to the DSC method of 50 to 100° C., more preferably, an iodine value of less than 15, a saponification value of 50 to 250, and a melting point according to the DSC method of 55 to 90° C., and most preferably, an iodine value of less than 5, a saponification value of 70 to 200, and a melting point according to the DSC method of 60 to 85° C. When the iodine value exceeds 25, the ester based wax readily is changed due to environmental influence, and the change in the chargeability of the material becomes large during continuous long term use, thus degrading the stability of images. When the saponification value is less than 30, the presence of unsaponifiable matter and hydrocarbon becomes large, thus causing filming on the photoconductive member and deteriorating the chargeability. When the saponification value is more than 300, the dispersibility in the resin deteriorates, thus increasing fog or toner scattering.

Furthermore, preferably, the material has a volume increase ratio of 2 to 30% when the temperature changes by 10° C. at temperatures equal to or more than the melting point. The rapid expansion in changing from solid to liquid strengthens adhesion among toner particles, when the toner is melted by heat for fixing, thus resulting in improved fixability, a better releasing property with respect to the fixing roller, and an improved anti-offset property. When the volume increase ratio is less than 2%, the effect is small, and when it is more than 30%, the dispersibility during kneading becomes lower.

A preferable amount of the ester based wax added is 0.1 to 20 parts by weight per 100 parts by weight of toner. When it is less than 0.1 parts by weight, the function to improve the fixability cannot be displayed, and when it is more than 20 parts by weight, the stability during storage hardly can be maintained.

Furthermore, the glass transition point of the toner in this case is 40–55° C., preferable 42–51° C., and more preferably 44–48° C. When the wax is dispersed uniformly and the miscibility improves, the glass transition point of the toner is lowered apparently and the fixability improves. In addition, the storage stability is maintained, so that the fixability and the storage stability can be good at the same time. When the glass transition point is less than 40° C., the durability of the toner deteriorates, and when it exceeds 55° C., the function to improve the fixability cannot be obtained.

Preferable examples thereof include natural waxes such as Japan wax, beeswax, ozocerite, carnauba wax, candelilla wax, montan wax, ceresin wax, and rice wax, synthetic waxes such as Fischer-Tropsch wax, derivatives of hydroxystearic acid, and polyhydric alcohol fatty acid ester such as glycerin fatty acid ester, glycol fatty acid ester, sorbitan fatty acid ester and the like.

Preferable examples of the derivatives of hydroxystearic acid include methyl 12-hydroxystearate, butyl 12-hydroxystearate, propylene glycol mono 12-hydroxystearate, glycerin mono 12-hydroxystearate, ethylene glycol mono 12-hydroxystearate and the like. Preferable examples of the glycerin fatty acid ester include glycerin monotristearate, glycerin docosanoate and the like. Preferable examples of the glycol fatty acid ester include propylene glycol fatty acid esters such as propylene glycol monopalmitate, propylene glycol monostearate and the like, and ethylene glycol fatty acid esters such as ethylene glycol monostearate and the like. Preferable examples of the sorbitan fatty acid ester include sorbitan monopalmitate, sorbitan monostearate, sorbitan monotristearate and the like. Furthermore, stearic acid ester of pentaerythritol, mixed esters of adipic acid and stearic acid or oleic acid and the like are preferable, and these can be used alone or in combinations of two or more.

Furthermore, the toner of the present invention comprises polyolefin wax that is graft modified with unsaturated carboxylic acid, having an acid number of 6 to 200 mg-KOH/g. This serves to improve the dispersibility of the ester based wax in the binding resin, and to alleviate overcharge of negative charges under high temperature and low humidity. It is believed that this results from an effect of charge leak from the polar group of the carboxylic acid.

Examples of the olefin having 3 to 10 carbon atoms that is a primary constituent of the skeleton include propylene, 1-butene, 1-pentene, 2-methyl-1-butene, 3-methyl-1-butene, 1-hexene, 4-methyl-1-pentene, 3-methyl-1-pentene, 2-methyl-1-pentene and the like.

Furthermore, in the embodiment of the present invention, the toner comprises a toner base and an external additive added to the toner base, and the toner includes a fixing assistant including meadowfoam oil derivatives or jojoba oil derivatives, a binding resin, and a colorant. The meadowfoam oil derivatives or jojoba oil derivatives have different chemical structures from those of commonly used polyethylene wax or polypropylene wax and have unique excellent effects.

Meadowfoam oil, whose scientific name is Limnanthes alba, is triglyceride obtained by collecting seeds of meadowfoam belonging to the Limnanthes family of the sealing wax order and squeezing the seeds. The meadowfoam oil is fatty oil triglyceride composed of fatty acid having 20 to 22 carbon atoms in a content of about 97%. The meadowfoam oil contains a large amount of eicosenoic acid (about 63%), erucic acid having 22 carbon atoms and one double bond (12%), isomers of erucic acid (2.5%) and fatty acid having 22 carbon atoms and two double bonds (about 18%). In other words, erucic acid is one kind of isomer of fatty acid contained in the meadowfoam oil. Unsaturated fatty acid mostly is monoenoic acid, and the unsaturation is low and the oxidation stability is good. The meadowfoam oil derivatives are made from the meadowfoam oil. Jojoba oil is collected from fruits of jojoba, and it is an ester based wax of unsaturated higher fatty acid and alcohol. The carbon number thereof typically is C40 and C42. Wax obtained by squeezing is liquid and becomes colorless and transparent when refined. The jojoba oil derivatives are made from the jojoba oil.

The primary function thereof is to serve as a fixing assistant to improve the fixability and strengthen the adhesion with a paper, and to reduce frictional resistance on the surface of images on a paper, and prevent peeling of the toner from the paper due to scrubbing, thus improving the fixability. Furthermore, in a color toner where a sharp melt resin is molten almost completely, the wax helps to improve the anti-offset property.

These materials have a high dispersibility with respect to styrene acrylic resins or polyester resins, which will be discussed later. The generation of fog in a non-image portion, image missing at a rear end in an entirely black image portion, and filming on the photoconductive member can be prevented. Furthermore, heating loss is small, and the filming on the photoconductive member or other members hardly occurs. When the fixing assistant of the present invention is applied to color toner, the sharp melt property can be provided. Further, the chargeability characteristics are stable under high temperature and humidity conditions and under low temperature and humidity conditions, and the particle flowability of the toner is stable, so that this is an appropriate material as a toner material.

In different electrophotographic processes, a variety of derivatives provide a material suitable to a process of interest by selecting a suitable derivative. For example, when the toner is used under high stress at high speed, a fatty acid metal salt can be selected so as to prevent degradation of the durability. When a sharp melt binding resin is used and better anti-offset properties are required, isocyanate polymer, or amide based derivatives can be used preferably. When the toner is used as a negatively charged toner, maleic acid derivatives or fatty acids can be used effectively.

Preferable examples of the meadowfoam oil derivatives include meadowfoam oil fatty acids, metal salts of meadowfoam oil fatty acids, meadowfoam oil fatty acid ester, hydrogenated meadowfoam oil, meadowfoam oil amide, homomeadowfoam oil amide, meadowfoam oil triester, maleic acid derivatives of epoxidized meadowfoam oil, isocyanate polymer of meadowfoam oil fatty acid polyhydric alcohol ester, and halogenated modified meadowfoam oil. These can be used alone or in combinations of two or more.

The meadowfoam oil fatty acid obtained by saponifying meadowfoam oil comprises fatty acid having 18 to 22 carbon atoms. As a metal salt thereof, metal salts of sodium, potassium, calcium, magnesium, barium, zinc, lead, manganese, iron, nickel, cobalt, aluminum or the like can be used.

Preferable examples of the meadowfoam oil fatty acid ester include methyl, ethyl, butyl and esters of glycerin, pentaerythritol, polypropylene glycol and trimethylol propane. Most preferable examples thereof include meadowfoam oil fatty acid pentaerythritol monoester, meadowfoam oil fatty acid pentaerythritol triester, meadowfoam oil fatty acid trimethylol propane ester or the like.

Furthermore, isocyanate polymer of meadowfoam oil fatty acid polyhydric alcohol ester, obtained by cross-linking a product from an esterification reaction between meadowfoam oil fatty acid and polyhydric alcohol such as glycerin, pentaerythritol and trimethylol propane with isocyanate such as tolylene diisocyanate (TDI), diphenyl methane-4,4'-diisocyanate (MDI) or the like, can be used preferably.

The hydrogenated meadowfoam oil is obtained by adding hydrogen to meadowfoam oil to convert unsaturated bonds to saturated bonds.

The meadowfoam oil amide can be obtained by hydrolyzing meadowfoam oil, and then effecting an esterification reaction to obtain fatty acid methyl ester, and reacting the fatty acid methyl ester with a mixture of concentrated ammonia water and ammonium chloride. Further, the melting point thereof can be regulated by adding hydrogen to this product. It is possible to add hydrogen before hydrolysis. A product having a melting point of 75 to 120° C. can be obtained. The homomeadowfoam oil amide can be obtained by hydrolyzing meadowfoam oil, and reducing to alcohol that is converted to nitrile thereafter.

Preferable examples of the jojoba oil derivatives include jojoba oil fatty acids, metal salts of jojoba oil fatty acids, jojoba oil fatty acid ester, hydrogenated jojoba oil, jojoba oil amide, homojojoba oil amide, jojoba oil triester, maleic acid derivatives from epoxidized jojoba oil, isocyanate polymer of jojoba oil fatty acid polyhydric alcohol ester, halogenated modified jojoba oil. These can be used alone or in combinations of two or more.

The jojoba oil fatty acid obtained by saponifying jojoba oil comprises fatty acid having 18 to 22 carbon atoms. As a metal salt thereof, metal salts of sodium, potassium, calcium, magnesium, barium, zinc, lead, manganese, iron, nickel, cobalt, aluminum or the like can be used.

Preferable examples of the jojoba oil fatty acid ester include methyl, ethyl, butyl, and esters of glycerin, pentaerythritol, polypropylene glycol and trimethylol propane. Most preferable examples thereof include jojoba oil fatty acid pentaerythritol monoester, jojoba oil fatty acid pentaerythritol triester, jojoba oil fatty acid trimethylol propane ester or the like.

Furthermore, isocyanate polymer of jojoba oil fatty acid polyhydric alcohol ester, obtained by cross-linking a product from an esterification reaction between jojoba oil fatty acid and polyhydric alcohol such as glycerin, pentaerythritol and trimethylol propane with isocyanate such as tolylene diisocyanate (TDI), diphenyl methane-4,4'-diisocyanate (MDI) or the like, can be used preferably. The hydrogenated jojoba oil is obtained by adding hydrogen to jojoba oil to convert unsaturated bonds to saturated bonds.

The jojoba oil amide can be obtained by hydrolyzing jojoba oil, and then effecting an esterification reaction to obtain fatty acid methyl ester, and reacting the fatty acid methyl ester with a mixture of concentrated ammonia water and ammonium chloride. Further, the melting point thereof can be regulated by adding hydrogen to this product. It is possible to add hydrogen before hydrolysis. A product having a melting point of 75 to 120° C. can be obtained. The homojojoba oil amide can be obtained by hydrolyzing jojoba oil, and reducing to alcohol that is converted to nitrile thereafter. Formula 11 shows the process of producing jojoba oil amide.

Formula 11

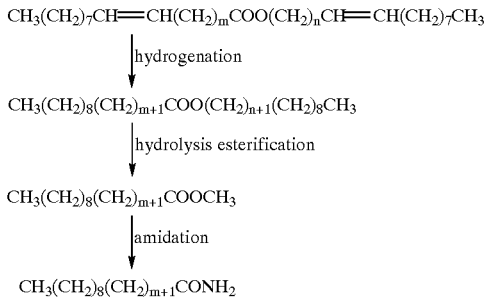

(m = 7, 9, 11, 13) (n = 8, 10, 12, 14)

Formula 12 shows the process of producing homojojoba oil amide.

Formula 12

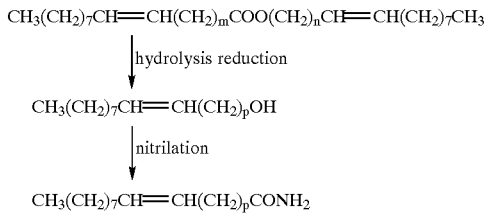

(m = 7, 9, 11, 13) (n = 8, 10, 12, 14) (p = 8, 10, 12, 14)

The jojoba oil triester is obtained by epoxidizing jojoba oil, hydrating the resultant for ring-opening, and effecting acylation with organic acid and fatty acid. Formula 13 shows the production process thereof.

Formula 13

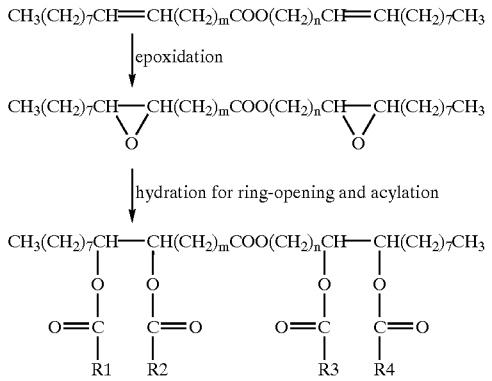

(R1, R2, R3, and R4 are alkyl groups or allyl groups having carbon atoms of 30 or less)

Preferable amounts of the fixing assistant added are 0.1 to 20 parts by weight per 100 parts by weight of toner. When it is less than 0.1 parts by weight, the effects of the fixability and the anti-offset properties might not be obtained. When it is more than 20 parts by weight, the storage stability becomes poor, or problems in the pulverization properties such as excessive pulverization may arise. The melting points of 40 to 130° C. are preferable, more preferably 45 to 120° C., and most preferably 50 to 110° C. A lower melting point than 40° C. deteriorates the storage stability, and a higher melting point than 130° C. deteriorates the fixing functions such as the fixability and the anti-offset properties.

In the molecular weights in GPC (gel permeation chromatography), Mn of 100 to 5000, Mw of 200 to 10000, Mw/Mn of not more than 8, and Mz/Mn of not more than 10 are preferable. More preferably, Mn is 100 to 5000, Mw is 200 to 10000, Mw/Mn is not more than 7, and Mz/Mn is not more than 9. Most preferably, Mn is 100 to 5000, Mw is 200 to 10000, Mw/Mn is not more than 6, and Mz/Mn is not more than 8. When Mn is less than 100 and Mw is less than 200, the storage stability deteriorates. Mn of more than 5000, Mw of more than 10000, Mw/Mn of more than 8, and Mz/Mn of more than 10 degrade the fixing functions such as the fixability and the anti-offset properties.

Other components can be used therewith. For example, vegetable waxes such as carnauba wax, candelilla wax, lanoline, Japan wax, beeswax, ozocerite, ceresin, and rice wax, polyolefin wax such as polyethylene wax, polypropylene wax or the like, higher fatty acids or metals thereof such as fatty acid amide, stearic acid, palmitic acid, lauric acid, aluminum stearate, barium stearate, zinc stearate, zinc palmitate, and ester derivatives can be used alone or in combinations of two or more.

For a binding resin that can be used suitably in the present invention, homopolymers or copolymers made from monomers of various vinyl types are preferable. Examples thereof include styrene or derivatives thereof such as o-methylstyrene, m-methylstyrene, p-methylstyrene, p-ethylstyrene, 2,4-di methylstyrene, p-n-butylstyrene, p-tert-butylstyrene, p-n-hexylstyrene, p-n-octylstyrene, and p-chlorostyrene. Most preferable is styrene.

Preferable acrylic monomers have a hydrogen atom or lower alkyl group having 1 to 3 carbon atoms as R1 in Formula 1, and a hydrogen atom, a hydrocarbon group having 1 to 12 carbon atoms, a hydroxylalkyl group, vinylester group, or an aminoacryl group as R2. Examples of the acrylic monomers include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, β-hydroxy ethyl acrylate, γ-hydroxy propyl acrylate, α-hydroxy butyl acrylate, β-hydroxy ethyl methacrylate, γ-amino propyl acrylate, γ-N,N-diethylamino propyl acrylate, ethylene glycol dimethacrylic acid ester, tetraethylene glycol dimethacrylic acid ester or the like. A preferable styrene-acrylic copolymer for the present invention is styrenelbutyl acrylate copolymer, and especially copolymer containing 75 to 85 wt % of styrene and 15 to 25 wt % of butyl acrylate is more preferable.

For a binding resin used suitably for the present invention, copolymers of (meth)acrylic monomers having a long chain alkyl group shown in Formula 2 with styrenes and (meth) acrylic monomers are used preferably. This improves the dispersibility of the fixing assistant significantly, and improves the fixability and the anti-offset properties. In addition, various environmental issues such as charge stability, charge increase under high temperature and humidity conditions, and poor control of toner concentration under high humidity (a mixture ratio of carrier and toner for two component development should be constant) can be suppressed. A preferable amount is 0.01 to 8 parts by weight per 100 parts by weight of the binding resin. An excessively small amount provides no effects, and an excessively large amount deteriorates the durability of the resin.

Furthermore, for a binding resin used suitably for the present invention, copolymers of (meth)acrylic monomers having an amino group shown in Formula 3 with styrenes and (meth)acrylic monomers are used preferably. Examples thereof include vinyl based monomers having an amino group such as dimethyl aminoethyl (meth)acrylate, diethyl aminoethyl (meth)acrylate, dibutyl aminoethyl (meth) acrylate or the like. This suppresses overcharge of the toner containing the fixing assistant under high temperature and humidity conditions, and stabilizes the charges, resulting in stability in image quality. This is effective not only for positively charged toner but also negatively charged toner. A preferable amount is 0.01 to 5 parts by weight per 100 parts by weight of the binding resin. An excessively small amount provides no effects, and an excessively large amount deteriorates the humidity resistance.

The polymer can be produced by any known polymerization methods such as bulk polymerization, mass polymerization, solution polymerization, suspension polymerization, and emulsion polymerization. It also is preferable to perform bulk polymerization until the polymerization ratio reaches 30 to 90 wt %, and then add a solvent and a polymerization initiator to continue the polymerization by solution polymerization.

In the present invention, in order to allow the toner to accommodate a wide range of development process rates (e.g., 140 mm/sec. to 480 mm/sec.), it is necessary not only to improve the fixability and the chargeability of the toner by improving the dispersibility of the additive during the kneading process, but also to enhance the permeability of the binding resin to a paper at thermal melting, to enhance the sliding property on the surface of toner fixed images, and to improve the anti-offset property. Thus, an appropriate viscoelasticity is required. In order to enhance the permeability to a paper and to improve the anti-offset property, it is preferable to specify a composition of a low molecular weigh polymer component and a high molecular weigh polymer component, a glass transition point and a molecular weight of the binding resin.

As for the binding resin as a whole, preferably, the weight average molecular weight Mw is 100000 to 600000, the ratio Mw/Mn of the weight average molecular weight Mw to the number average molecular weight Mn is 50 to 100, the ratio Mz/Mn of the Z average molecular weight Mz to the number average molecular weight Mn is 350 to 1200, and the 1/2 outflow temperature (hereinafter, referred to as a softening point) measured by a koka-type flow tester (Capillary Rheometer Flowtester CFT-5000, manufactured by Shimadzu) is 100 to 145° C.

More preferably, the weight average molecular weight Mw is 120000 to 450000, the ratio Mw/Mn of the weight average molecular weight Mw to the number average molecular weight Mn is 60 to 95, the ratio Mz/Mn of the Z average molecular weight Mz to the number average molecular weight Mn is 500 to 1100, and the softening point is 105 to 135° C. Most preferably, the weight average molecular weight Mw is 150000 to 450000, the ratio Mw/Mn of the weight average molecular weight Mw to the number average molecular weight Mn is 70 to 95, the ratio Mz/Mn of the Z average molecular weight Mz to the number average molecular weight Mn is 600 to 1100, and the softening point is 110 to 135° C. In order to further improve the fixability and the pulverization property during pulverization at the production steps, the binding resin preferably contains 50 to 95 wt % of styrene based components. The temperature of the binding resin at outflow start measured by the flow tester preferably is 80 to 120° C., more preferably 85 to 110° C., most preferably 85 to 100° C.

When Mw is less than 100000, Mw/Mn is less than 50, Mz/Mn is less than 350, the softening point is less than 100° C., and the outflow start temperature is less than 80° C., the shearing force hardly can be applied during kneading, the dispersibility of the fixing assistant may deteriorate, and the anti-offset property at low speed may deteriorate. When Mw is more than 600000, Mw/Mn is more than 100, Mz/Mn is more than 120, the softening point is more than 145° C., and the outflow start temperature is more than 120° C., the fixability at high speed may deteriorate, and the pulverization property may deteriorate.

The Z average molecular weight best represents the size and the amount of the molecular weight in a tailing portion on the side of high molecular weight, and affects significantly the characteristics of the toner to which the fixing assistant is added. As Mz is larger, the resin strength becomes larger and the viscosity during thermal melting and kneading becomes larger, thus resulting in a significantly improved dispersibility. Fog and toner scattering can be prevented, and environmental changes under high temperature and humidity conditions or high humidity conditions can be suppressed. A large Mz/Mn means a wide distribution up to an ultrahigh molecular weight region, and provides good meltability and high melt viscosity during the kneading.

The molecular weight is a value measured by gel permeation chromatography (GPC) using several types of monodisperse polystyrene as a standard sample. The measurement was performed with an apparatus manufactured by TOSOH CORP. (HPLC8020 series), using TSK GEL G5000 HHR+ G3000HHR (7.8 mm diameter—30 cm×2) as a column and THF (tetrahydrofuran) as an eluent, at a flow rate of 1.0 mL/min. and an injection amount of 50 $\mu$L. using RI as a detector, and at a temperature of 40° C. The measurement requirement is that the molecular weight distribution of subject samples is in a range where the logarithms and the count numbers of the molecular weights in the analytical curve obtained from several types of monodisperse polystyrene standard samples form a straight line.

As the softening point of the binding resin, the following procedure is used: Using a flow tester (CFT500) manufactured by Shimadzu Corporation, 20 kg/cm$^2$ of loading is applied to a sample of 1 cm$^3$ by a plunger while heating the sample at a temperature increase rate of 6° C./min, so as to extrude the sample through a nozzle with a diameter of 1 mm. In the relationship between the falling amount of the plunger and the temperature increase characteristics, when the height of the characteristics line is h, the softening point (Tm) is a temperature corresponding to h/2, and the outflow start temperature (Ti) is a temperature at which the sample starts to flow by the extrusion.

For the melting point at endothermic peaks according to the DSC method, a differential calorimeter DSC-50 manufactured by Shimadzu Corporation was used. The temperature was raised to 200° C. at 5° C./min., and retained for 5 minutes, and reduced to 10° C. rapidly. Then, the temperature was retained for 15 minutes, and raised at 5° C./min. Then, the melting point was obtained from the endothermic (melt) peaks. The amount of the sample introduced to a cell was 10 mg±2 mg.

For the toner of the present invention, the fixing assistant is added internally to the binding resin beforehand. In general, a binding resin, a colorant, a charge controlling agent and a fixing assistant are blended in the pre-blending step. In order to blend them uniformly, a certain level of agitation force is required, so that the temperature necessarily rises in the bath of the blending apparatus. Therefore, the fixing assistant with a low melting point agglomerates, thus leading to poor dispersion. This problem can be solved by dispersing the fixing assistant in the binding resin. More specifically, the binding resin is dissolved in a solvent as described below so as to prepare a binding resin solution, and the fixing assistant is added thereto and blended. The solvent is removed from the binding resin solution at 120 to 250° C. under atmospheric pressure or reduced pressure. The temperature preferably is 150 to 220° C. in view of preventing heat deterioration of the binding resin or the fixing assistant and the efficiency in removing the solvent. The fixing assistant is added to the binding resin solution and then the solvent is removed so that the phase separation of the binding rein and the fixing assistant can be suppressed and the miscibility thereof can improve. Moreover, the dispersibility of the fixing assistant during the pre-blending step can improve, and the dispersibility of the colorant and other internal additives can improve.

The heating loss of the fixing assistant at 220° C. preferably is not more than 8 wt %. When the heating loss is 8 wt % or more, in the step of removing the solvent from the binding resin solution, the removal cannot be performed sufficiently, and the solvent remains in the binding resin. For this reason, the glass transition temperature of the binding resin is reduced significantly, thus impairing the storage stability of the toner. The entire amount of the fixing assistant that is intended to be added can be added to the binding resin, or a part of the amount can be added in the pre-blending step. The amount preferably is 0.1 to 10 parts by weight per 100 parts by weight of the binding resin. When it is 0.1 parts by weight or less, the dispersibility hardly can improve, and when it is 10 parts by weight or more, the efficiency in removing the solvent deteriorates and poor productivity results.

Examples of the solvent used in the step of removing solvent include hydrocarbon based solvents such as benzene, triol, xylol, cyclohexane, and solvent naphtha, alcohol solvents such as methanol, ethanol, iso-propyl alcohol, n-butyl alcohol, sec-butyl alcohol, iso-butyl alcohol, amyl alcohol, and cyclohexanol, ketone based solvents such as acetone, methylethyl ketone, methyl isobutyl ketone, and cyclohexanone, ester based solvents such as ethyl acetate, n-butyl acetate, and cellosolve acetate, and ether based solvents such as methyl cellosolve, ethyl cellosolve, butyl cellosolve and methyl carbitol.

In the embodiment of the present invention, as the binding resin, polyester resin obtained by condensation polymerization between polycarboxylic acid or a lower alkyl ester thereof and polyhydric alcohol can be used preferably. Examples of the polycarboxylic acid or lower alkyl ester thereof include aliphatic dibasic acids such as malonic acid, succinic acid, glutaric acid, adipic acid, and hexahydrophthalic anhydride, aliphatic unsaturated dibasic acids such as maleic acid, maleic anhydride, fumaric acid, itaconic acid, and citraconic acid, and aromatic dibasic acids such as phthalic anhydride, phthalic acid, terephthalic acid, and isophthalic acid, and methyl esters and ethyl esters thereof. Among these, aromatic dibasic acids such as phthalic acid, terephthalic acid, and isophthalic acid and lower alkyl esters thereof are preferable.

Examples of the polyhydric alcohol include diol such as ethylene glycol, 1,2-propylene glycol, 1,3-propylene glycol, 1,3-butylene glycol, 1,4-butylene glycol, 1,6-hexane diol, neopentylglycol, diethylene glycol, a dipropylene glycol, bisphenol A ethylene oxide adduct, and a bisphenol A propylene oxide adduct, triol such as glycerin, trimethylol propane, and trimethylol ethane, and mixtures thereof. Among these, neopentylglycol, trimethylol propane, a bisphenol A ethylene oxide adduct and a bisphenol A propylene oxide adduct are preferable.

For the polymerization, condensation polymerization, solution condensation polymerization or the like can be performed. This can provide good toner without compromising the anti-vinyl chloride matting property or the colors of color materials of color toner.

The ratio of polycarboxylic acid and polyhydric alcohol to be used generally is a ratio of the number of hydroxyl groups to the number of carboxylic groups (OH/COOH) and generally is 0.8 to 1.4.

The acid number of the polyester resin preferably is 1 to 100. When it is less than 1, the dispersibility of the fixing assistant deteriorates, and when it is more than 100, the humidity resistance deteriorates.

For this polyester resin, preferably, the weight average molecular weight Mw is 10000 to 300000, the ratio Mw/Mn of the weight average molecular weight Mw to the number average molecular weight Mn is 3 to 50, the ratio Mz/Mn of the Z average molecular weight Mz to the number average molecular weight Mn is 10 to 800, the 1/2 outflow temperature (hereinafter, referred to as a softening point) measured by a koka-type flow tester is 80 to 150° C., and the outflow start temperature is 80 to 120° C.

For toner for color process where images of four colors superimposed are formed and fixed, in view of transmittance and glossiness, preferably, the weight average molecular weight Mw is 10000 to 180000, the ratio Mw/Mn of the weight average molecular weight Mw to the number average molecular weight Mn is 3 to 20, the ratio Mz/Mn of the Z average molecular weight Mz to the number average molecular weight Mn is 10 to 300, the softening point is 85 to 120° C., and the outflow start temperature is 80 to 110° C. More preferably, the weight average molecular weight Mw is 10000 to 150000, the ratio Mw/Mn of the weight average molecular weight Mw to the number average molecular weight Mn is 3 to 16, the ratio Mz/Mn of the Z average molecular weight Mz to the number average molecular weight Mn is 10 to 260, the softening point is 90 to 115° C., and the outflow start temperature is 85 to 110° C. Most preferably, the weight average molecular weight Mw is 10000 to 100000, the ratio Mw/Mn of the weight average molecular weight Mw to the number average molecular weight Mn is 5 to 12, the ratio Mz/Mn of the Z average molecular weight Mz to the number average molecular weight Mn is 14 to 220, the softening point is 95 to 115° C., and the outflow start temperature is 85 to 105° C.

For black toner for black and white process for one color development, transmittance and smoothness are not required to be considered significantly. However, for example, when it is necessary to accommodate a wide range of development process rates (e.g., 140 mm/sec. to 480 mm/sec.), it is necessary not only to improve the fixability and chargeability of the toner by improving the dispersibility of the additive during the kneading process, but also to enhance the permeability of the binding resin to a paper at thermal melting, to enhance the sliding property on the surface of toner fixed images, and to improve the anti-offset property. Thus, an appropriate viscoelasticity is required.

Therefore, preferably, the weight average molecular weight Mw is 50000 to 300000, the ratio Mw/Mn of the weight average molecular weight Mw to the number average molecular weight Mn is 5 to 50, the ratio Mz/Mn of the Z average molecular weight Mz to the number average molecular weight Mn is 50 to 800, the softening point is 90 to 150° C., and the outflow start temperature is 80 to 120° C. More preferably, the weight average molecular weight Mw is 80000 to 250000, the ratio Mw/Mn of the weight average molecular weight Mw to the number average molecular weight Mn is 7 to 45, the ratio Mz/Mn of the Z average molecular weight Mz to the number average molecular weight Mn is 100 to 700, the softening point is 95 to 146° C., and the outflow start temperature is 85 to 115° C. Most preferably, the weight average molecular weight Mw is 100000 to 220000, the ratio Mw/Mn of the weight average molecular weight Mw to the number average molecular weight Mn is 9 to 45, the ratio Mz/Mn of the Z average molecular weight Mz to the number average molecular weight Mn is 150 to 600, the softening point is 100 to 142° C., and the outflow start temperature is 85 to 110° C.

In the embodiment of the present invention, silica fine powder is used where a content of a component having a polydimethyl siloxane skeleton in the silica that is extracted by an organic solvent is not more than 2.5 wt % is used. Moreover, toner is used where a content of a component having a polydimethyl siloxane skeleton in the toner that is extracted by an organic solvent, including silica treated or coated with silicone oil, is not more than 0.09 wt %. Thus, various toner powder characteristics and development characteristics can be achieved.

The component having a polydimethyl siloxane skeleton is a primary skeleton that silicone oil based materials can have, and shown by Formula 14.

Formula 14

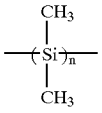

(n is an integer of 1 to 400)

The silica is so-called dried or fumed silica generated by vapor phase oxidization of silicon halogenated compounds. The silanol group present on the surface thereof is treated and coated with a silane coupling agent or a silicone oil based material, so that the humidity resistance can improve. Especially, the treatment with a silicone oil based material improves hydrophobicity and thus improves the durability and the humidity resistance further. Moreover, the filming on the photoconductive member or the transfer member can be suppressed.

For an organic photoconductive member, a charge transporting agent such as stilbene, hydrazone, or triphenyl amine compounds is dispersed in a polycarbonate resin, and is applied in a thickness of about 15 to 25 $\mu$m to the surface.

However, although the material generally is not likely to cause filming, filming on the photoconductive member occurred in use with the toner using the silica treated and coated with a silicone oil material.

Moreover, the contamination of a development sleeve causes non-uniformity in layer formation of the toner, fog during development, reduction in density after continuous long period use, or non-uniformity in layer formation on the development sleeve. In addition, the fixing strength is reduced in heat roll fixation.

It is believed that because the toner using silica treated or coated with a silicone oil based material has a high affinity with a resin film such as polycarbonate resin used for the organic photoconductive member, the filming on the photoconductive member occurred. When this factor was pursued further, it was found that the following effect was large: When silica is treated with a silicone oil based material, the material is not entirely reacted with or adhered to the silica, but, for example when the silica is treated with dimethyl silicone oil, a residual component having a polydimethyl siloxane skeleton remains in the silica. This residual amount may induce the filming on the photoconductive member.

However, it was found that limiting the amount of the residual component having a polydimethyl siloxane skeleton to a predetermined amount or less can stabilize the development properties such as fog or image density without lowering the fixability, and prevent the filming on the photoconductive member or the like after long period use.

Furthermore, in two component development where the magnetic changes (changes in magnetic permeability) in a developer are detected so that the concentration ratio of the carrier and the toner is constant, for example, when a magnetic permeability sensor is used, the operation for toner concentration control tends to be unstable at high temperature.

Moreover, overcharge readily is caused under low humidity, resulting in deterioration in the image density. When the toner is left under high temperature and humidity for a long period, the toner concentration control is not performed well, resulting in an overtoner phenomenon where the toner is supplied excessively. Thus, fog and scattering tend to be caused.

However, it was found that using hydrophobic silica having a reduced amount of the residual component having a polydimethyl siloxane skeleton can prevent overcharge under low humidity so as to prevent deterioration of the image density, and stabilize the operation of the toner concentration control at high temperature.

Examples of the silicone oil based material used to treat silica include dimethyl silicone oil, methyl hydrogen silicone oil, methyl phenyl silicone oil, cyclic dimethyl silicone oil, epoxy modified silicone oil, carboxyl modified silicone oil, carbinol modified silicone oil, methacrylic modified silicone oil, mercapto modified silicone oil, polyether modified silicone oil, methyl styryl modified silicone oil, alkyl modified silicone oil, fluorine modified silicone oil, amino modified silicone oil, and chlorophenyl modified silicone oil. Silica that is treated with one silicone oil selected from the group consisting of the above-described silicone oils is used preferably. For example, products by Toray-Dow Corning Co., Ltd., SH200, SH510, SF230, SH203, BY16-823, BY16-855B and the like are preferable.

For example, 100 parts by weight of colloidal silica fine powder #200 (manufactured by Nippon Aerojil) are mixed with 25 parts by weight of dimethyl silicone oil (KF-96, 100 cs, manufactured by SHINETSU CHEMICAL CO. LTD.) that is diluted in a solvent by a Henshel mixer, and dried. Then, the mixture is heated at 260° C. Furthermore, a silicone oil based material may be spayed to silica. Alternatively, a silicone oil based material may be dissolved or dispersed in a solvent, and mixed with silica fine powder. Thereafter, the solvent may be removed therefrom. The silicone oil based material preferably is compounded in an amount of 0.1 to 8 parts by weight per 100 parts by weight of silica.

In order to limit the amount of the residual component having a polydimethyl siloxane skeleton to a predetermined amount or less, for example, the time period and the temperature for heating after drying are optimized. Alternatively, a dimethyl silicone oil with silanol groups at both ends having a high reactivity is used to improve the reactivity so that the amount of residual unreacted components having a polydimethyl siloxane skeleton is reduced. Furthermore, a method of washing with a solvent after treatment with a silicone oil based material, a method of blowing a component with a low boiling point by heat such as hot air blowing, or a treatment in a high temperature bath can be used to remove the residual component. Any other method can be used as long as it limits the amount of the residual component having a polydimethyl siloxane skeleton to a predetermined amount or less.

A method for measuring the amount of the residual component will be described. Silica powder is weighed in an amount of, for example, 1 to 2 g. A solvent that readily can dissolve polydimethyl siloxane, such as chloroform, is added thereto and the mixture is centrifuged. This centrifugation is performed at a high rotation rate (e.g., 20000 $min^{-1}$) because it is difficult to precipitate. Then, supernatant is collected, and these operations are repeated. The chloroform is allowed to evaporate and the resultant product is dried (by blowing air at room temperature). Heavy chloroform (1 ml of $CDCL_3$) is added, and measurement is performed with $^1$H-NMR to identify polydimethyl siloxane. H of Si—$CH_3$ of polydimethyl siloxane has a chemical shift in the vicinity of 0.5 ppm. This is a peak position characteristic to H of a methyl group bonded to Si, and easily can be distinguished from those of other organic products having other chemical structures. For quantitation, 1 $\mu$l of an internal standard is added when the heavy chloroform is added in the procedures of the qualitative analysis (the internal standard has simple NMR peaks that are overlapped as little as possible with the peaks of the sample, a high atmospheric pressure, and a concentration that hardly changes after addition, and an example thereof is DMF).

After the $^1$H-NMR measurement, the amount is determined with an integral value. A relative ratio to the internal standard determines a molar ratio of the polydimethyl siloxane in 1 ml of the heavy chloroform, and the molar ratio is converted to a weight approximately. The content of the polydimethyl siloxane is calculated from the amount of the silica powder collected at first.

This method makes it possible to quantitate polydimethyl siloxane with a precision up to 10 ppm. Other identification methods include $^{13}$C-NMR, $^{29}$Si-NMR or the like.

In the case of toner powder, the analysis is performed substantially in the same manner as in the case of the silica powder. First, the amount of toner powder to be collected is adjusted based on the mixture ratio of silica in the toner powder. For example, when the amount of the silica powder contained is 0.1 wt %, 50 to 100 g of toner is collected. When a paramagnetic metal (Fe, Ni or the like) is contained in the toner, it is removed. The metal can be removed by converting it to a hardly-hydrated product to be precipitated. Alternatively, a high molecular weight portion can be separated by GPC or the like. The sample is analyzed in the same manner as above. In this manner, it is possible to quantitate the toner.

As to the silica, hydrophobic silica having a BET specific surface area by nitrogen adsorption of 30 to 350 $m^2/g$ is added to a toner base externally. More preferably, the specific surface area is 50 to 300 $m^2/g$, and most preferably 80 to 250 $m^2/g$. When the specific surface area is less than 30 $m^2/g$, the flowability of the toner is not improved, and the storage stability deteriorates. When the specific surface area is more than 350 $m^2/g$, the silica agglomerates to a great extent so that the external additive cannot be added uniformly. The hydrophobic silica is compounded in an amount of 0.1 to 5 parts by weight, more preferably 0.2 to 3 parts by weight, per 100 parts by weight of the toner base particles. When it is less than 0.1 parts by weight, the flowability of the toner is not improved, and when it is more than 5 parts by weight, floating silica may increase and contaminate the inside of the machine.

It also is preferable to perform the silicone oil treatment after a silane coupling treatment. Examples of silane coupling agents include dimethyl dichlorosilane, trimethyl chlorosilane, allyldimethyl chlorosilane, hexamethyl disilazane, allylphenyl dichlorosilane, benzyl methyl chlorosilane, vinyl trietoxysilane, γ-methacryl oxypropyl trimethoxysilane, vinyl triacetoxysilane, divinyl chlorosilane, dimethyl vinyl chlorosilane or the like. The silane coupling agent treatment can be performed in a dry treatment where the fine powder is fluidized by agitation or the like, and evaporated silane coupling agent is reacted with the fluidized powder, or a wet treatment where a silane coupling agent dispersed in a solvent is dripped into the fine powder for reaction.

Furthermore, it is preferable that the toner contains a metal acid salt fine powder including at least one selected from the group consisting of titanate based fine powder and zirconate based fine powder having an average particle size of 0.02 to 4 μm and a BET specific surface area by nitrogen adsorption of 0.1 to 100 $m^2/g$. This results in good characteristics. This is particularly effective for the charge retention characteristics during continuous use under low humidity for the toner including the fixing assistant such as meadowfoam oil derivatives. This also is effective to stabilize the charge for recycled waste toner and prevent filming.

Examples of the material include $SrTiO_3$, $BaTiO_3$, $MgTiO_3$, $AlTiO_3$, $CaTiO_3$, $PbTiO_3$, $FeTiO_3$, $SrZrO_3$, $BaZrO_3$, $MgZrO_3$, $AlZrO_3$, $CaZrO_3$, $PbZrO_3$, $SrSiO_3$, $BaSiO_3$, $MnSiO_3$, $CaSiO_3$, and $MgSiO_3$.

Furthermore, when powder of these metal acid salts is prepared by a hydrothermal method or an oxalate thermal decomposition method, the effects are enhanced. This is because the generated material has a uniform particle size and a shape close to spherical rather than an irregular shape. When the average particle size is 0.02 μm or less, and the BET specific surface area by nitrogen adsorption is more than 100 $m^2/g$, the particles agglomerate intensely and the dispersibility deteriorates. When the average particle size is more than 4 μm, and the BET specific surface area by nitrogen adsorption is less than 0.1 $m^2/g$, the damage to the photoconductive member by the particles may increase.

The fine powder can be synthesized under hydrothermal conditions by a hydrothermal oxidization method, a hydrothermal precipitation method, a hydrothermal synthesis method, a hydrothermal dispersion method, a hydrothermal crystallization method, a hydrothermal hydrolysis method, a hydrothermal Attrider mixture method, a hydrothermal mechanochemical method or the like. Preferable methods are a hydrothermal oxidization method, a hydrothermal precipitation method, a hydrothermal synthesis method, a hydrothermal dispersion method, and a hydrothermal hydrolysis method.

The fine powder that is synthesized by these methods is not significantly agglomerated, has a narrow particle size distribution, and is spherical fine powder having good flowability. Therefore, when the fine powder is added to the toner externally, it is dispersed well and adheres to the toner uniformly. In addition, since it is spherical, it causes no undesired damages to the photoconductive member.

Furthermore, it is preferable to provide a metal oxide fine powder including at least one selected from the group consisting of titanium oxide fine powder, aluminum oxide fine powder, strontium oxide fine powder, tin oxide fine powder, zirconium oxide fine powder, magnesium oxide fine powder, and indium oxide fine powder, each having an average particle size of 0.02 to 2 μm, a BET specific surface area by nitrogen adsorption of 0.1 to 100 $m^2/g$ and an electrical resistivity of $10^9$ Ωcm or less, in the toner including the fixing assistant such as meadowfoam oil derivatives.

More preferably, the average particle size is 0.02 to 0.8 μm, and the BET specific surface area by nitrogen adsorption is 1.0 to 85 $m^2/g$. Even more preferably the average particle size is 0.02 to 0.1 μm, the BET specific surface area by nitrogen adsorption is 8 to 85 $m^2/g$, and most preferably the average particle size is 0.02 to 0.06 μm, and the BET specific surface area by nitrogen adsorption is 10 to 85 $m^2/g$.

This can stabilize the toner charge under high temperature and low humidity, improve the transfer rate, and improve the waste toner recycle property in the toner including the fixing assistant such as meadowfoam oil derivatives. This also can stabilize the operation for the toner concentration control when the toner is used in the two component development.

When the average particle size is less than 0.02 μm and the BET specific surface area by nitrogen adsorption is more than 100 $m^2/g$, a high level of agglomeration may be caused so that uniform dispersion is not achieved during the external addition treatment. When the electrical resistivity is more than $10^9$ Ωcm, the above-described effects are reduced. When the average particle size is more than 2 μm and the BET specific surface area by nitrogen adsorption is less than 0.1 $m^2/g$, the detachment from the toner base may be caused to a great extent so that poor durability is affected, and damage to the photoconductive member becomes serious.

Furthermore, it is preferable to provide a metal oxide fine powder including titanium oxide fine powder and/or silica oxide fine powder whose surface is coated with a mixture of tin oxide and antimony, each having a BET specific surface area by nitrogen adsorption of 1 to 200 $m^2/g$, in the toner including the fixing assistant such as meadowfoam oil derivatives. When the BET specific surface area by nitrogen adsorption is more than 200 $m^2/g$, uniform mixing may be difficult to achieve, and when it is less than 1 $m^2/g$, the detachment from the toner may be caused to a great extent so that the durability of the toner is reduced.

Furthermore, it is preferable to provide a metal oxide fine powder including magnetic fine powder having an average particle size of 0.02 to 2.0 μm and a ratio D25/D75 of 25% residual diameter D25 to 75% residual diameter D75 of 1.3 to 1.7, a BET specific surface area by nitrogen adsorption of 0.5 to 80 $m^2/g$, an electrical resistivity of $10^2$ to $10^{11}$ Ωcm, a bulk density of 0.3 to 0.9 g/cc, a compression ratio of 30 to 80%, a capacity of absorbing linseed oil in an amount of 10 to 30 (ml/100 g), a remnant magnetization of 5 to 20 emu/g, and a saturation magnetization of 40 to 80 emu/g in the toner including the fixing assistant such as meadowfoam oil derivatives.

The addition of the metal oxide fine powder is effective for the charge retention characteristics during continuous use under low humidity for the toner including the fixing assistant such as meadowfoam oil derivatives. This also is effective to stabilize the charge for recycled waste toner and prevent filming.

Examples of the magnetic fine powder include metal powder of magnetite, iron, manganese, cobalt, nickel and chromium, alloys thereof, ferromagnetic oxide metals such as chromium oxide, iron sesquioxide, triiron tetroxide, alloys thereof and compounds including these metals.

Preferable shapes of the magnetic fine powder are spherical or octahedral. The magnetic fine powder preferably has an average particle size of 0.02 to 2.0 μm and a ratio D25/D75 of 1.3 to 1.7. More preferably, the average particle size is 0.05 to 1.0 μm and a ratio D25/D75 of 1.3 to 1.6. Most preferably, the average particle size is 0.05 to 0.5 μm and a ratio D25/D75 is 1.3 to 1.5.

When the particle size of the magnetic fine powder is less than 0.02 μm or D25/D75 is less than 1.3, the ratio of small diameter particles becomes high, and high level of agglomeration results so that the dispersibility during mixing cannot improve, and thus further effects of the addition are not exhibited. When the particle size of the magnetic fine powder is more than 2.0 μm or D25/D75 is more than 1.7, the ratio of large diameter particles becomes high, and the width of the particle size distribution becomes large so that both of the ratio of large diameter particles and the ratio of small diameter particles are high. Therefore, poor image quality may result, it may become difficult to achieve uniform adhesion onto the surface of the toner base, or damages to the photoconductive member may increase. Microphotographs are taken by a scanning electron microscope and 100 particles were selected at random to measure the particle diameters.

The BET specific surface area by nitrogen adsorption of the magnetic fine powder preferably is 0.5 to 80 $m^2/g$. More preferable specific surface areas are 2 to 60 $m^2/g$, even more preferably 10 to 60 $m^2/$, and most preferably 18 to 60 $m^2/g$. When the specific surface area is less than 0.5 $m^2/g$, the contact ratio with the toner base is reduced, so that further effects of the addition of the magnetic particles hardly can be obtained. When the specific surface area is more than 80 $m^2/g$, the particles may agglomerate to a great extent and the dispersion during mixing is not uniform. Thus, the effects on the development property and the toner concentration control stability hardly can be obtained. The BET specific surface area was measured by FlowSorb II2300 manufactured by Shimadzu Corporation.

The resistance of the magnetic fine powder preferably is $10^2$ to $10^{11}$ Ωcm, more preferably $10^5$ to $10^{10}$ Ωcm, and most preferably $10^6$ to $10^9$ Ωcm. For powder having a low resistance, the charge amount is reduced under high humidity, and fog and toner scattering may increase. For powder having a high resistance, the effect of suppressing overcharge under high temperature and low humidity is weakened.

The volume electrical resistance was measured in the following manner. One ml of magnetic particle material was placed in a cylindrical container including an electrode with an inner diameter of 20 mm on the bottom surface thereof and an insulating material at the side wall thereof. Then, an electrode board with a diameter of slightly less than 20 mm and a weight of 100 g was placed on the subject material, and allowed to stand for 1 hour. Then, a direct current voltage of 100V was applied across the electrodes, so that a current value 1 minute after the application was measured, and thus the volume electrical resistance was calculated.

The bulk density of the magnetic fine powder preferably is 0.3 to 0.9 g/cc, and the compression ratio preferably is 30 to 80%. More preferably, the bulk density is 0.4 to 0.9 g/cc and the compression ratio is 40 to 70%. Most preferably, the bulk density is 0.5 to 0.9 g/cc and the compression ratio is 45 to 65%. When the bulk density is more than 0.9 g/cc and the compression ratio is less than 30%, the density of the developer itself becomes dense when it is placed under high humidity for a long period, and thus the toner concentration control may become unstable under high humidity, and overtoner results. When the bulk density is less than 0.3 g/cc and the compression ratio is more than 80%, the particles may agglomerate to a great extent, which prevents uniform mixing, and the effect of suppressing overcharge under high temperature and low humidity cannot be exerted. The bulk density and the compression ratio were measured by Powder Tester manufactured by HOSOKAWA MICRON CORP. The compression ratio is calculated by dividing a difference between the bulk density and a tap density, which is a looseness specific gravity, by the tap density, and multiplying the result by 100. It also is preferable to pulverize the magnetic fine powder. This preferably can be performed by a mechanical pulverizer provided with a high speed rotator or a pressure dispersing machine provided with a pressure roller. The magnetic fine powder preferably has a capacity of absorbing linseed oil in an amount of 10 to 30 ml/100 g. The same effects as those of the preferable compression ratios and bulk densities described above can be obtained. This was measured according to Japanese Industrial Standard K 5101-1978.

The magnetic fine powder preferably has a remnant magnetization of 5 to 20 emu/g and a saturation magnetization of 40 to 80 emu/g under a magnetic field of 1 kOe. The addition of such fine powder particularly is found to have an effect on reduction of fog on the photoconductive member under high humidity. It is believed that by adding the magnetic fine powder, the magnetic fine powder stands with the head thereof upward on the surface of the toner adhered to the photoconductive member as fog and is collected by a scraping effect. Thus, the fog is reduced.

When the surface of the magnetic fine powder is treated with a titanium based coupling agent, a silane based coupling agent, an epoxysilane coupling agent, an acrylsilane coupling agent, or an aminosilane coupling agent, the toner characteristics improve. For example, titanate based coupling agents such as isopropyl triisostearoyl titanate, tetrabutoxy titanium, isopropyl tris(dioctylpyrophosphate) titanate, isopropyl tris(N-aminoethyl-aminoethyl)titanate, tetraoctyl bis(ditridecyl phosphate)titanate, bis(dioctyl pyrophosphate)oxyacetate titanate, bis (dioctylpyrophosphate)ethylene titanate, isopropyl trioctanoyl titanate, isopropyl dimethacryl isostearoyl titanate or the like; silane based coupling agents such as vinyl trietoxysilane, vinyl tris(β-methoxyethoxy)silane, γ-methacryloxypropyltrimethoxysilane, γ-glycidoxypropyltrimethoxysilane, β-(3,4 epoxycyclohexyl)ethyltrimethoxysilane, N-β-(aminoethyl) γ-aminopropyl methyldimethoxysilane, γ-aminopropyltrietoxysilane, N-phenyl-γ-aminopropyltrimethoxysilane, γ-mercaptopropyltrimethoxysilane, γ-chloropropyltrimethoxysilane or the like; acryl silane coupling agents such as γ-methacryloxypropyltrimethoxysilane or the like; epoxy silane coupling agents such as β-ethyltrimethoxysilane, γ-glycidoxypropyltrimethoxysilane, γ-glycidoxypropylmethyldiethoxysilane or the like; and aminosilane coupling agents such as N-βaminoethyl γ-aminopropyltrimethoxysilane, N-βaminoethyl γ-aminopropylmethyldietoxysilane, γ-aminopropyltriethoxysilane, N-phenyl-γ-aminopropyltrimethoxysilane, or the like can be used for the surface treatment. For example, a dry process where a magnetic substance is reacted with an evaporated silane coupling agent or a wet process where a magnetic substance is dispersed in a solvent and a silane coupling agent is dripped therein for reaction, or other known methods can be used for the treatment.

The amount of the metal oxide fine powder and/or metal acid salt fine powder externally added preferably is 0.1 to 5 parts by weight per 100 parts by weight of the toner base. When it is less than 0.1 parts by weight, the function is not displayed, and when it is more than 5 parts by weight, the humidity resistance deteriorates.

Furthermore, the toner of the embodiments of the present invention can be used preferably as a magnetic single component toner. For example, this is used preferably in the following development method. A thin film layer of the toner is formed on a development sleeve with a rigid magnetic blade or an elastic rubber-like blade, and direct or alternating current is applied thereto while the thin layer is in contact or contactless with the photoconductive member, so as to form toner images.

A conventional toner including synthetic wax such as polyethylene or polypropylene is likely to cause the filming on the photoconductive member, so that the number of papers is required to be restricted. The toner including silica having a reduced amount of a residual component having polydimethyl siloxane of the present invention prevents the filming so that the life of the photoconductive member can increase.

Furthermore, so-called sleeve ghost, where a hysteresis of previous images remains on the development sleeve after development, can be prevented.

In this case, examples of the magnetic substance added to the magnetic toner include metal powder of iron, manganese, nickel, cobalt or the like, and ferrite of iron, manganese, nickel, cobalt, zinc, magnetite or the like. The magnetic substances that have been described above as the preferred examples of the metal oxide fine powder can be used preferably.

The amount of the magnetic substance added preferably is 5 to 50 wt %. When it is 5 wt % or less, toner scattering increases, and when it is more than 50 wt %, the charge amount of the toner is reduced, and this tends to cause poor image quality.

Furthermore, the toner of the embodiments of the present invention can be used preferably as a two component developer. A preferable carrier is a magnetic substance coated with a resin containing conductive fine powder. Preferable examples of the conductive fine powder include metal powder; carbon black; conductive oxides such as titanium oxide or zinc oxide; powder of titanium oxide, zinc oxide, barium sulphate, aluminum borate, potassium titanate or the like whose surface is coated with tin oxide, carbon black or metal. The specific resistance preferably is $10^{10}$ Ω·cm or less.

As a core material of the carrier, metal powder of magnetite, iron, manganese, cobalt, nickel, or chromium having an average particle size of 20 to 100 μm, preferably 30 to 80 μm, and most preferably 30 to 60 μm, and alloys thereof, chromium oxide, iron sesquioxide, triiron tetroxide, Cu—Zn ferrite, Mn—Zn ferrite, Ba—Ni ferrite, Ni—Zn ferrite, Li—Zn-ferrite, Mg—Mn ferrite, Mg—Zn—Cu ferrite, Mn ferrite, Mn—Mg ferrite, Li—Mn ferrite or the like can be used. Among these, most preferable examples are substances having a volume resistivity of $10^8$ to $10^{14}$ Ωcm, and Mn ferrite, Mn—Mg ferrite, and Li—Mn ferrite, in terms of environmental protection and also because the shapes are closer to spheres than those of Cu—Zn based materials. When the average particle size is less than 20 μm, the carrier adhesion increases, and when it is more than 100 μm, a high definition image quality hardly can be obtained. When the volume resistivity is less than $10^8$ Ωcm, the carrier adhesion increases, and when it is more than $10^{14}$ Ωcm, the image density is reduced due to the charge-up of the developer.

In order to form a coating film on the core material of the carrier, known coating methods such as a dipping method of dipping powder of a core material of the carrier in a solution for forming a coating layer, a spraying method of spraying a solution for forming a coating layer on a surface of a carrier core material, a fluidized bed method of spraying a solution for forming a coating layer to a carrier core material while the carrier core material is floated by fluidizing air, or a kneader and a coater method of mixing a carrier core material and a solution for forming a coating layer in a kneader and coater, and removing a solvent, can be used.

Examples of a resin used as a coating layer of the carrier include straight silicone resin including an organosiloxane bond and modified products thereof such as alkyd modified, epoxy modified, urethane modified products, fluorine resin, styrene resin, acrylic resin, methacrylic resin, polyester resin, polyamide resin, epoxy resin, polyether based resins, phenol based resins or the like. These can be used alone or in combination. Moreover, copolymers thereof can be used.

In the toner of the embodiments of the present invention, a coating layer of a mixed system of a silicone based resin and an acrylic resin is advantageous to the toner containing the fixing assistant such as the meadowfoam oil derivatives. In particular, a mixed system of a silicone resin having a straight chain molecular structure including only an alkyl group having 1 to 4 carbon atoms such as a methyl group as the side chain group thereof, a silicone resin having a straight chain molecular structure including a phenyl group as the side chain group thereof, and a (meth)acrylic resin is preferable. As the silicone based resin, a cold setting silicone resin is preferable. For example, KR271, KR255, KR152 (manufactured by Shin-Etsu Chemical Co., Ltd.), SR2400, SR2406, SH840 (manufactured by Toray Silicone) can be used. Preferable examples of the acrylic resin include alkyl (meth)acrylic acid ester polymer resins such as (meth) acrylic acid, methyl (meth)acrylate, ethyl (meth)acrylate, butyl (meth)acrylate, dodecyl (meth)acrylate, octyl (meth) acrylate, isobutyl (meth)acrylate, and 2 ethylhexyl (meth) acrylate. When the resin including alkyl (meth)acrylate polymer including a long chain alkyl having 14 to 26 carbon atoms shown in Formula 1 is used as the coating layer, the characteristics improve further.

For the toner of the embodiments of the present invention, the characteristics thereof can improve by performing a surface improvement treatment with hot air. This treatment stabilizes the flowability of the toner including the fixing assistant such as the meadowfoam oil derivatives or waxes, and the development property, so that the durability and the recycle property can improve. The external additive is exposed on the surface of the toner by the heating with hot air, so that the fixing characteristics such as the fixability and the anti-offset property can improve.

When the surface improvement treatment by hot air can be performed after the external addition of at least one of the hydrophobic silica, the metal oxide fine powder, and the metal acid salt fine powder to the toner base, good characteristics result. When the external addition of at least one of the hydrophobic silica, the metal oxide fine powder, and the metal acid salt fine powder is performed further after the surface improvement treatment, even better characteristics result.

Furthermore, when the hydrophobic silica or the metal oxide fine powder is fixed and adhered to the surface of the toner base, the toner can be prevented from fusing to a cleaning blade. In recycle of waste toner, the external additive is prevented from being detached, so that the durability improves further.

In a two component development system where magnetic variations (changes in magnetic permeability) of the developer are detected so that the concentration ratio of the carrier and the toner is constant, for example, when a magnetic permeability sensor is used, a packing phenomenon after long term exposure to high humidity is alleviated, so that toner concentration control can be stabilized. Thus, increases of the overtoner phenomenon where the toner is supplied excessively, fog, or scattering can be avoided.

The present invention will be described with reference to the drawings. FIG. 1 is a schematic drawing of an apparatus for surface improvement treatment by hot air. Pulverization and classification are performed for a predetermined particle size distribution, and toner particle 101 is introduced from a constant rate supplier 102, supplied to a dispersion nozzle 104 for dispersing particles with compressed air 103, and sprayed in a direction of about 45 degrees. In the present invention, two dispersion nozzles 104 are positioned left-right symmetrically. By spraying from a plurality of nozzles, the toner can be treated more uniformly. Hot air 106 is emitted from a hot air generator 105 to radiate the hot air to the toner 101 sprayed from the dispersion nozzles 104. In the present invention, a heater is used. This is not limited thereto, and any apparatus including one using propane gas can be used, as long as it can generate hot air. The toner 101 passes through the hot air 106 while dispersing, where the surface improvement treatment is performed. The surface-improved toner is taken into a hood 107, supplied to a cyclone 110, and collected in a collection box 111. Numeral 112 denotes a bag filter, numeral 114 denotes a blower, numeral 113 denotes an airflow meter, and numeral 115 denotes a thermometer.

The surface-improved particles that are taken in the hood 107 can be subjected to a cooling treatment with a cool air 109 generated from a cool air generator 108. This quick cooling can stabilize the state of the treatment. The air volume can be determined suitably depending on the amount of the toner treated. The distance from the point where the particles is treated with the hot air to the point where the particles are exposed to the cool air can be determined depending on the amount of the toner treated, but preferably is 10 to 100 cm, and more preferably 20 to 80 cm. The cooling treatment preferably is performed by air that is cooled to 10° C. or lower by a cooler, but is not limited thereto. For example, methods of water-cooling, placing cooled solid products such as dry ice around the pipe, or the like can be used.

Since the method described in the embodiments of the present invention is a continuous system, the production efficiency improves with this method. Moreover, since the surface improvement is performed while the toner is in the form of dispersion, the particles are prevented from being fused to each other and coarse particles are prevented from being generated. In addition, this is simple and compact. The temperature in the wall of the apparatus does not rise, and a product collection rate is high, and there is substantially no possibility of dust explosion because the vessel is an open type. Since the treatment is performed instantly, the particles are not agglomerated to each other and the entire carrier particles are treated uniformly. The temperature of the hot air in this case preferably is 60° C. to 600° C., more preferably 100° C. to 500° C., and most preferably 150° C. to 350° C. When it is 60° C. or less, the effect of the surface improvement treatment cannot be obtained. When it is 600° C. or more, the toner base particles are likely to agglomerate each other. A preferable air volume of the hot air is 0.35 to 1.0 $Nm^3$/min at a wind pressure of 3 to 5 $kg/cm^2G$. A preferable air volume for raw material dispersion is 0.05 to 0.5 $Nm^3$/min at a wind pressure of 1 to 3 $kg/cm^2G$. A preferable ratio of the air volume of the hot air to the air volume for raw material dispersion is 10:1 to 4:1. When the air volume of the hot air is excessively high, the raw material is repelled so that uniform treatment might not be performed. When the air volume for raw material dispersion is excessively high, the raw material passes through the hot air so that uniform treatment might not be performed.

The toner of the embodiments of the present invention is used preferably in an electrophotographic apparatus provided with a toner transfer system where a transfer material is inserted in an image support and a conductive elastic roller, and toner images on the image support are transferred to the transfer material with electrostatic force by applying a transfer bias voltage to the conductive elastic roller. Such a toner transfer system uses contact transfer, so that a mechanical force other than the electric force may affect the transfer. Therefore, reverse polar toner adhered to a surface of the photoconductive member that should not be transferred may be transferred, or toner adhered to the surface of the photoconductive member may contaminate the surface of the transfer roller in the absence of a paper and contaminate the back surface of a transfer paper.

In this case, the toner containing silica having a reduced amount of residual components having a polydimethyl siloxane skeleton prevents the filming of the toner or detached silica on the surface of the transfer roller. Thus, image defects caused by retransfer of the toner or the detached silica from the surface of the transfer roller to the surface of the photoconductive member can be prevented. Moreover, thinning caused by agglomeration of the toner during transfer can be prevented, and contamination of a transfer paper by unwanted toner particles can be prevented.

The good dispersion of the fixing assistant or the wax in the toner base or the addition of the metal oxide fine powder and/or the metal acid salt fine powder stabilizes the chargeability, and the fixation treatment on the surface of the toner by performing the surface improvement treatment prevents thinning during transfer.

Furthermore, the filming of a toner component on the surface of the photoconductive member, which is caused by the fact that the toner component is detached from the toner, can be prevented.

Furthermore, since the filming of the toner or the detached fixing assistant such as meadowfoam oil derivatives on the surface of the transfer roller can be prevented, image defects caused by retransfer of the toner or the detached fixing assistant such as meadowfoam oil derivatives from the surface of the transfer roller to the surface of the photoconductive member can be prevented. Moreover, contamination of a transfer paper by unwanted toner particles can be prevented.

The toner of the embodiments of the present invention is used preferably in an electrophotographic apparatus provided with a waste toner recycle system for collecting toner left on the image support after a transfer process to the development device and utilizing the toner in a development process again. In such a system, when waste toner is reused for development, the additive may drop off by a mechanical impact in a cleaning device, a transporting pipe connecting the cleaning device and a development device, and the development device during the collection of the waste toner from the cleaning device to the development device, or filming may be caused on the photoconductive member.

In the waste toner recycle system, the toner containing silica having a reduced amount of residual components having a polydimethyl siloxane skeleton prevents the filming of the toner or silica on the photoconductive member, and the chargeability and the flowability can be maintained after a long term continuous use.

Even if the toner is used as a two component developer, the component having a polydimethyl siloxane skeleton does not contaminate the carrier, so that the durability of the carrier can improve.

Furthermore, the fixing assistant such as meadowfoam oil derivatives is added to the toner base so that the dispersibility thereof improves, and therefore, images can be obtained with reduced background fog.

Furthermore, the fixation treatment on the surface of the toner is performed by the surface improvement treatment so that the chargeability and the flowability can be prevented from being changed over time even if it is used continuously for a long period. Since the surface of the fixing assistant such as meadowfoam oil derivatives is coated with an external additive, it cannot be dropped off, and the filming on the photoconductive member can be prevented. Moreover, waste toner that is returned to the development section has substantially the same adhesion state of the external additive as before, so that the chargeability and the flowability are not changed.

The toner of the embodiments of the present invention can be used preferably as a magnetic single component toner. The toner is used in a system where an electrostatic latent image support including a fixed magnet is used, magnetic toner is powdered on the electrostatic latent image support where electrostatic latent images are formed, so as to adhere thereto magnetically, and is transported with the support to a toner collection electrode roller. An alternating bias is applied to the electrode roller so that toner in a non-image portion on the electrostatic image support is removed by electrostatic force and magnetic force. In order words, the electrophotographic method of the present invention is more compact and has higher performance by providing a magnet inside the electrostatic latent image support in the cascade development method, and applying an alternating current voltage to the electrode.

However, since the structure of the development steps is simple, the toner is charged in a reduced number of opportunities so that it may be difficult to obtain high charge characteristics. Furthermore, since the toner is adhered to the entire surface of the electrostatic latent image support at the time of development, toner filming is more likely to be caused than in a conventional single component development method because the toner is in contact with the entire surface of the electrostatic latent image support.

However, the toner base where the fixing assistant such as meadowfoam oil derivatives is dispersed better or the addition of silica, the metal oxide fine powder and/or the metal acid salt fine powder having a reduced amount of residual components having a polydimethyl siloxane skeleton can prevent the chargeability and the flowability from changing over time even if it is used continuously for a long period, high chargeability can be obtained, high image density can be obtained, and scattering of the toner in the vicinity of images can be eliminated, so that high definition images can be obtained.

Furthermore, since the surface of the fixing assistant such as meadowfoam oil derivatives is coated with an external additive by the fixation treatment on the surface of the toner by the surface improvement treatment, it cannot be dropped off and the filming on the photoconductive member can be prevented.

Furthermore, the toner can be used preferably in other magnetic single component development methods. For example, the toner can be used preferably in a development method where a thin film layer of the toner is formed on a development sleeve with a rigid magnetic blade or elastic rubber-like blade, and direct or alternating current is applied thereto while the thin layer is in contact or contactless with the photoconductive member, so as to form toner images. A conventional toner including synthetic wax such as polyethylene or polypropylene is likely to cause the filming on the photoconductive member, so that the number of papers is required to be restricted. The toner of the present invention prevents the filming on the photoconductive member so that the life of the photoconductive member can increase. Specific examples of the magnetic substance that is added to the magnetic toner include metal powder of iron, manganese, nickel, cobalt or the like, and ferrite of iron, manganese, nickel, cobalt, zinc, magnetite or the like. The magnetic substances that have been described above as the preferred examples of the metal oxide fine powder can be used preferably.

The amount of the magnetic substance added preferably is 5 to 50 wt %. When it is 5 wt % or less, toner scattering increases, and when it is more than 50 wt %, the charge amount of the toner is reduced, and this tends to cause poor image quality.

Furthermore, the toner of the embodiments of the present invention can be used preferably in an electrophotographic apparatus provided with the following transfer system. A first transfer process where toner images formed on an image support are transferred onto a surface of an endless intermediate transfer member while the surface of the image support is contacted with the surface of the intermediate transfer member is repeated a plurality of times, and a second transfer process where superimposed transfer toner images that are formed on the surface of the intermediate transfer member by the plurality times of repeated operations of the first process are transferred collectively onto a transfer material.

The toner using silica including a small amount of residual components having a polydimethyl siloxane skeleton of the embodiments of the present invention reduces generation of filming, stabilizes charge, reduces thinning during transfer, and reduces contamination of a transfer paper by unwanted toner particles. Furthermore, since the filming of the toner or detached silica on the surface of the transfer roller can be avoided, image defects caused by retransfer of the toner or the detached silica from the surface of the transfer roller to the surface of the photoconductive member can be avoided.

Furthermore, the high level of dispersion of the fixing assistant such as meadowfoam oil derivatives in the embodiments of the present invention reduces thinning during transfer and reduces filming of a low softening material on an intermediate transfer member caused by the material being detached from the toner, so that the contamination of a transfer paper by unwanted toner particles can be avoided.

Furthermore, image defects caused by retransfer of the toner or the detached low softening material from the surface of the transfer roller to the surface of the photoconductive member can be avoided. The adhesion between the toner particles becomes small, and agglomeration of the toner is reduced. Therefore, "thinning", which is a phenomenon where a toner agglomeration effect causes part of images not to be transferred and makes a hole, can be reduced, and deterioration in the transfer efficiency can be suppressed.

The toner of the embodiments of the present invention can be used suitably in the following electrophotographic apparatus. The apparatus includes a rotating photoconductive member and development devices, each of which has a different color toner. A plurality of movable image formation units, each of which forms toner images for a different color on the photoconductive member, are provided annularly so as to form a group of image formation units. The entire group of image formation units is rotated so as to move and toner images for different colors formed on the photoconductive member are registered on a transfer material and transferred thereon. Thus, color images can be formed.

In this structure, since the entire group of image formation units is rotated, the photoconductive member is first cleaned with a cleaning blade, and waste toner detached from the photoconductive member may adhere to the photoconductive member again temporarily and repeatedly. Therefore, when an internal additive such as waxes is not dispersed uniformly, the waste toner contains a large amount of toner including the wax that is dispersed poorly. As a result, the repeated contacts of the waste toner and the photoconductive member may cause the filming on the image support, resulting in reduction in the life of the photoconductive member.

Furthermore, the rotation of the image formation units causes the toner to move up and down intensely so that the toner may drop off from a sealing portion. This requires strengthening sealing at the sealing portion, and therefore, in the toner including the poorly dispersed wax, fusion is caused and makes a mass, resulting in image noise such as black or white stripes.

Furthermore, the toner may be detached from the development roller temporarily, and when the charge rising property is poor at an early stage of the development, this causes background fog. The toner including the poorly dispersed wax deteriorates the charge rising property at an early stage of the development.

However, when the toner containing silica including a small amount of residual components having a polydimethyl siloxane skeleton of the present invention is used, the filming on the photoconductive member is reduced. In addition, since the charge rising property is good, there is no background fog at the early stage of the development.

Furthermore, since the fixing assistant such as meadowfoam oil derivatives or the like is dispersed uniformly, the charge rising property improves. Therefore, there is no background fog at the early stage of the development. There is also no filming on the photoconductive member.

Furthermore, in the fixing of full color images, since the toner of the embodiments of the present invention uses polyester having a low softening point, even if images for four color toners are superimposed, the fixing can be performed in the form of a substantially complete melt. Moreover, since the fixing assistant such as meadowfoam oil derivatives or the like is dispersed to a great extent, good anti-offset properties can result in oil-free fixation where oil is not used, and fixed images with glossiness and no dull colors can be obtained.

The fixing assistant such as meadowfoam oil derivatives or the like included in the binding resin has an effect of reducing friction on the surface of images. Furthermore, satisfactory storage stability at high temperature can result. Therefore, in the color images requiring transmittance and glossiness, since the toner of present invention provides high definition color reproduction properties and good release effects, the fixing device can be made compact.

Furthermore, even if a binding resin containing a large amount of high molecular weight components is used, both of the fixing strength at high speed and the anti-high temperature offset property at low speed can be obtained. Therefore, the toner can be used throughout from high speed apparatuses to low speed apparatuses.

In the embodiments of the present invention, a suitable pigment or dye can be compounded in a binding resin in order to color toner and/or control charges. Examples of such a pigment or dye include carbon black, iron black, graphite, nigrosine, a metal complex of azo dye, salicylic acid metal salt, aniline blue, phthalocyanine blue, Hansa Yellow G, rhodamine 6C lake, chalco oil blue chrome yellow, quinacridone, benzidine yellow, rose bengal, Du Pont oil red, triallylmethane based dyes or the like. These can be used alone or in combinations of two or more. An amount necessary for coloring and/or charge control is added to the binding resin.

The toner can be produced by pre-blending, melting and kneading, pulverization and classification, and external addition.

In the pre-blending treatment, a binding resin and an additive to be dispersed in the binding resin are blended for uniform dispersion with a mixer or the like provided with an agitation blade. As the mixer, Super mixer (manufactured by Kawata Seisakusho), Henshel mixer (manufactured by Mitsui-Miike Kogyo), PS mixer (manufactured by Shinko Pantec Co., Ltd.), Ledige mixer or any known mixers can be used.

In the melting and kneading treatment, the additive is dispersed in the binding resin by shearing force. This treatment is performed by using a partitioned segment type kneading machine where a cylinder and a kneading shaft are partitioned into a plurality of segments and is performed at the temperature conditions described above.

In the pulverization and classification treatment, a toner mass obtained by kneading and cooling is pulverized into coarse particles, for example with a cutter mill, and then pulverized into fine particles, for example with a jet mill pulverizer (e.g., IDS pulverizer, Nihon Newmatic Kogyo). Further, if necessary, the fine particles are classified by an air stream classifier so as to obtain toner particles (toner base particles) having a desired particle size distribution. It is possible to pulverize and classify the particles mechanically. For example, toner is introduced in a small gap between a fixed stator and a roller that is rotating opposed to the stator, and pulverized (e.g., Criptron pulverizer manufactured by Kawasaki Heavy Industries, Ltd. and a Turbo mill manufactured by Turbo Kogyo). This classification treatment provides toner particles (toner base particles) having a volume average particle size of, generally 5 to 12 $\mu$m, and preferably 5 to 9 $\mu$m.

In the external addition treatment, an external additive such as silica is mixed with the toner particles (toner base particles) obtained by the classification. For this treatment, a Henshel mixer, Super mixer or other known mixers can be used.

In the embodiments of the present invention, in order to obtain particles having a predetermined particle size distribution for the pulverized particles, some fine powder is cut off by classification. The cut-off fine powder is reused by mixing with a material such as a binding resin in the pre-blending treatment. This not only reduces the amount of toner that is disposed of as industrial waste, but also reduces the cost of the toner.

The fine powder toner and the toner base component materials are mixed in a ratio of 2:98 to 40:60 in the pre-blending treatment.

However, in the reuse of the fine powder, when conventionally used polyethylene or polypropylene wax is used, the dispersion tends to be non-uniform, and fog and toner scattering increases, and the toner is more susceptible to environmental changes. Therefore, it is not possible to add such a wax that can improve the fixability and the release property.

However, when the fixing assistant of meadowfoam oil derivatives, jojoba oil derivatives, ester based waxes having an iodine value of 25 or less and a saponification value of 30 to 300, or polyolefin wax that is graft-modified with unsaturated carboxylic acid and has an acid number of 6 to 200 mgKOH/g is added, there is no increase in fog and toner scattering when the classified fine powder toner is reused. Rather, the dispersibility improves, and the amount of waste toner can be reduced. This is believed to result from the improvement of the dispersibility by a pump priming effect.

The use of silica having a small amount of residual components having a polydimethyl siloxane skeleton, the addition of the metal oxide fine powder and/or the metal acid salt, and the surface improvement treatment improve the development properties and the environmental stability further.

EXAMPLES

Next, the present invention will be described by way of examples more specifically.

Table 1 shows the monomer composition of the binding resin used in the examples.

TABLE 1

| Binding resin | Monomer 1 | Monomer 2 | Monomer 3 |
|---|---|---|---|
| RS-1 | styrene | butyl acrylate | |
| RS-2 | styrene | butyl acrylate | acrylic acid having an alkyl group with 20 carbon atoms |
| RS-3 | styrene | butyl acrylate | dimethyl amino ethyl methacrylate |
| RM-1 | bisphenol A propylene oxide adduct | terephthalic acid | succinic anhydride |

Table 2 shows the heat characteristics of the binding resin used in the examples.

TABLE 2

| Binding resin | Tg | Mn | Mw | Mz | Mw/Mn | Mz/Mn | Tm | Ti |
|---|---|---|---|---|---|---|---|---|
| RS-1 | 59 | 2800 | 190000 | 1630000 | 68 | 582 | 131 | 105 |
| RB-2 | 60 | 3100 | 210000 | 1840000 | 67 | 594 | 130 | 106 |
| RS-3 | 58 | 2700 | 210000 | 1950000 | 78 | 722 | 135 | 108 |
| RM-1 | 59 | 3100 | 16000 | 62000 | 5.2 | 20 | 108 | 91 |

In Table 2, Tg (°C.) represents a glass transition point. Mn represents a number average molecular weight. Mw represents a weight average molecular weight. Mz represents Z average molecular weight. Tm (°C.) and Ti (°C.) represent a softening point and an outflow start temperature measured by a flow tester.

Table 3 shows the binding resin to which a fixing assistant is added internally used in the examples.

TABLE 3

| Binding resin | |
|---|---|
| RS-12 | 2 parts by weight of fixing assistant W1 is added to a toluene solution of 100 parts by weight of binding resin RS-1, and the solvent is removed. |
| RS-22 | 3 parts by weight of fixing assistant W3 is added to a toluene solution of 100 parts by weight of binding resin RS-2, and the solvent is removed. |
| RS-32 | 5 parts by weight of fixing assistant W4 is added to a toluene solution of 100 parts by weight of binding resin RS-3, and the solvent is removed. |

Table 4 shows the fixing assistant used in the examples.

TABLE 4

| Sample | Fixing assistant |
|---|---|
| W-1 | maximum hydrogenated meadowfoam oil (an iodine value of 2, a saponification value of 90) |
| W-2 | meadowfoam oil fatty acid barium salt |
| W-3 | jojoba oil fatty acid pentaerythritol monoester |
| W-4 | meadowfoam oil amido |
| W-5 | jojoba triester |
| W-6 | maleic acid derivatives of epoxidized meadowfoam oil |
| W-7 | isocyanate polymer of jojoba oil fatty acid ester of propylene glycol |
| W-8 | glycerin = mono12-hydroxysearate (an iodine value of 5, a saponification value of 80) |

Table 5 shows the hydrophobic silica used in the examples.

TABLE 5

| Hydrophobic silica | Material | BET value ($m^2/g$) | Amount of residual component (wt %) |
|---|---|---|---|
| SG-1 | silica treated with amino modified silicone oil | 140 | 0.05 |
| SG-2 | silica treated with dimethyl silicone oil | 150 | 0.06 |
| SG-3 | silica treated with dimethyl silicone oil having silanol group at terminal | 100 | 0.1 |
| SG-4 | silica treated with methyl phenyl silicone oil | 200 | 0.08 |
| SG-5 | silica treated with dimethyl silicone oil | 80 | 3.0 |

As for the silica, 100 g of silica fine powder was dispersed in a solution where 5 g of silicone oil is dissolved in 1 l of toluene, and spray-drying was performed so that the silica becomes hydrophobic. For SG-1 and 2, unreacted polydimethyl siloxane was washed with a benzene solvent after that treatment. For SG-4, unreacted polydimethyl siloxane was removed by heat in blowing hot air. For SG-3, dimethyl silicone oil having a high reactivity having silanol groups at both terminals was used.

Table 6 shows the metal oxide fine powder or metal acid salt fine powder used in the examples.

TABLE 6

| Second external additive | Material | Average particle size (μm) | BET value ($m^2/g$) |
|---|---|---|---|
| G-1 | barium titanate prepared by hydrothermal synthesis | 0.2 | 5.04 |
| G-2 | strontium zirconate prepared by oxalate thermal decomposition method | 0.67 | 2.63 |
| G-3 | titanium oxide | 0.05 | 30.5 |
| G-4 | tin oxide | 0.08 | 12.0 |
| G-5 | zirconium oxide | 0.2 | 6.5 |
| G-6 | magnesium oxide | 0.05 | 32 |
| G-7 | indium oxide | 0.1 | 10.5 |
| G-8 | silica oxide whose surface is coated with tin oxide-antimony | 0.04 | 83.2 |

Table 7 shows the magnetic substance salt fine powder used in the examples.

TABLE 7

| Magnetic body | Md (μm) | D25/D75 | Mdet ($m^2$/g) | Mr (Ω cm) | Mad (g/cc) | Mpac (%) | Mam (ml/100 g) | Rr (emu/g) | Ss (emu/g) |
|---|---|---|---|---|---|---|---|---|---|
| MG-1 | 0.05 | 1.44 | 30.5 | $10^7$ | 0.68 | 48 | 22 | 12 | 59 |
| MG-2 | 0.17 | 1.48 | 9.2 | $10^7$ | 0.70 | 50 | 20 | 12 | 60 |
| MG-3 | 0.32 | 1.33 | 4.3 | $10^6$ | 0.72 | 55 | 19 | 8.9 | 59 |
| MG-4 | 0.17 | 1.50 | 7.5 | $10^8$ | 0.6 | 60 | 12 | 12 | 60 |

In Table 7, Md (μm) represents an average particle size, Mbet ($m^2$/g) represents a BET specific surface area, Mr (Ωcm) represents a volume resistance, Mad (g/cc) represents a bulk density, Mpac (%) represents a compression degree, Mam (ml/100 g) represents a capacity of absorbing linseed oil in an amount, Rr (emu/g) represents remnant magnetization, and Ss (emu/g) represents saturation magnetization. MG-4 is a sample that was subjected to a surface treatment with an isopropyl triisostearoyl an titanate coupling agent.

Table 8 shows the carrier material compositions used in the examples.

TABLE 8

| Carrier | Magnetic core material | Coating layer material | Mixing ratio | Volume resistance | Average particle size |
|---|---|---|---|---|---|
| C1 | Mn—Mg-ferrite | Methyl silicone resin/butyl acrylate | 7/3 | $10^{10}$Ω cm | 60 μm |
| C2 | Mn—Li-ferrite | Methyl silicone resin/phenyl silicone resin/butyl acrylate | 2/6/2 | $10^{12}$Ω cm | 40 μm |
| C3 | Mn ferrite | Methyl silicone resin/phenyl silicone | 2/6/2 | $10^{12}$Ω cm | 40 μm |

TABLE 8-continued

| Carrier | Magnetic core material | Coating layer material | Mixing ratio | Volume resistance | Average particle size |
|---|---|---|---|---|---|
| | | resin/butyl acrylate | | | |

Table 9 shows the charge controlling agents and the pigments used in the examples.

TABLE 9

| Material No. | Composition |
|---|---|
| CCA1 | S34 (made by Orient Chemical) |
| CCA2 | salicylic acid salt E-84 (made by Orient Chemical) |
| CB1 | carbon black MA100A (made by Mitsubishi Chemical) |
| MC-1 | azo based magenta pigment |
| CC-1 | copper phthalocyanine-based cyan pigment |
| CY-1 | benzidine-based yellow pigment |

Table 10 shows the toner material compositions used in the examples. Each of the toners has a weight average particle size of 6 to 7 μm, a variation index in the volume particle size distribution of 20 to 25%, and a variation index in the number particle size distribution of 25 to 30%

TABLE 10

| Toner No. | Binding resin | Charge controlling agent | Pigment etc. | Meadowfoam derivatives | Hydrophobic silica | Second external additive |
|---|---|---|---|---|---|---|
| A1 | RS-1 | CCA1 (2) | MG-1 (60) | W-2 (3) | SG-1 (1.0) | |
| A2 | RS-2 | CCA1 (2) | MG-2 (60) | W-4 (5) | SG-2 (0.8) | G-1 (1) |
| A3 | RS-3 | CCA1 (2) | MG-3 (60) | W-6 (5) | SG-3 (0.9) | G-3 (1) |
| A4 | RS-12 | CCA1 (2) | MG-4 (60) | W-1 (3) | SG-1 (1.0) | MG-1 (2) |
| A5 | RS-22 | CCA1 (2) | MG-1 (60) | W-8 (6) | SG-2 (0.8) | MG-3 (1) |
| A6 | RS-32 | CCA1 (2) | MG-2 (60) | W-5 (2) | SG-4 (0.9) | G-5 (1) |
| J1 | RS-1 | CCA1 (2) | MG-1 (60) | polyethylene (4) | SG-5 (1.0) | |
| A7 | RS-1 | CCA1 (2) | CB1 (8) | W-8 (7) | SG-1 (1.0) | |
| A8 | RS-2 | CCA1 (2) | CB1 (8) | W-2 (5) | SG-2 (0.8) | MG-2 (1.5) |
| A9 | RS-3 | CCA1 (2) | CB1 (8) | W-1 (3) | SG-1 (1.0) | MG-4 (1) |
| A10 | RS-12 | CCA1 (2) | CB1 (8) | W-5 (4) | SG-3 (0.8) | |
| A11 | RS-22 | CCA1 (2) | CB1 (8) | W-4 (6) | SG-4 (1.0) | G-2 (1) |
| A12 | RS-32 | CCA1 (2) | CB1 (8) | W-6 (5) | SG-2 (0.8) | G-3 (0.5) |
| A13 | RS-3 | CCA1 (2) | CB1 (8) | W-3 (2) | SG-1 (1.0) | G-4 (0.8) |
| A14 | RS-2 | CCA1 (2) | CB1 (8) | W-7 (4) | SG-3 (1.0) | G-8 (1) |
| J2 | RS-1 | CCA1 (2) | CB1 (8) | polyethylene (4) | SG-5 (1.0) | |
| A15 | RM-1 | CCA2 (1.5) | CB1 (8) | W-1 (8) | SG-2 (0.8) | G-7 (0.5) |
| A16 | RM-1 | CCA2 (1.5) | MC-1 (5) | W-5 (7) | SG-3 (0.9) | G-7 (1) |
| A17 | RM-1 | CCA2 (1.5) | CC-1 (5) | W-4 (6) | SG-1 (1.0) | G-7 (1) |
| A18 | RM-1 | CCA2 (1.5) | CY-1 (5) | W-6 (5) | SG-4 (1.0) | G-7 (1) |
| A19 | RM-1 | CCA2 (1.5) | MC-1 (5) | W-3 (6) | SG-2 (0.8) | G-8 (1) |
| A20 | RM-1 | CCA2 (1.5) | CC-1 (5) | W-7 (8) | SG-3 (0.9) | G-6 (0.5) |
| A21 | RM-1 | CCA2 (1.5) | CY-1 (5) | W-8 (8) | SG-1 (1.0) | G3 (1) |

As to the ratio in the mixing amount of the pigment, the charge controlling agent, and the organic material, the ratio in the mixing amount (parts by weight) thereof on the basis of 100 parts by weight of the binding resin is parenthesized. The second external additive refers to the metal oxide fine powder or metal acid salt fine powder hereinafter. As for the silica and the second external additive, the mixing amount thereof on the basis to 100 parts by weight of the toner base is shown in Table 10. For toner Nos. A6, and A14, the ratio of the fine powder toner to the toner base component material that is blended in the pre-blending step is 10:90.

Table 11 shows the toner base, the silica, the surface treatment temperature and the second external additive compositions in the surface improvement treatment used in the examples.

TABLE 11

| Toner No. | Toner base | Silica 1 | Second external additive 1 | Surface treat-ment | Silica 2 | Second external additive 2 |
|---|---|---|---|---|---|---|
| A22 | A1 | — | — | 300° C. | SG-1 (0.5) | G-1 (1) |
| A23 | A2 | SG-2 (0.5) | — | 350° C. | SG-2 (0.4) | G8 (1) |
| A24 | A3 | SG-3 (0.3) | G-7 (0.3) | 350° C. | SG-3 (0.3) | G-7 (0.3) |
| A25 | A7 | — | — | 300° C. | SG-1 (0.4) | — |
| A26 | A8 | SG-2 (0.4) | — | 300° C. | SG-2 (0.5) | MG-1 (0.8) |
| A27 | A9 | SG-3 (0.3) | MG4 (0.4) | 350° C. | SG-3 (0.3) | MG4 (0.4) |
| A28 | A10 | SG-3 (0.3) | G-7 (0.3) | 350° C. | SG-3 (0.3) | G-7 (0.3) |
| A29 | A11 | SG-1 (0.6) | G-3 (0.5) | 300° C. | SG-1 (0.6) | G-3 (0.5) |
| A30 | A16 | — | — | 300° C. | SG-1 (0.5) | G-8 (0.5) |
| A31 | A17 | — | — | 300° C. | SG-1 (0.5) | G-8 (1) |
| A32 | A18 | — | — | 300° C. | SG-1 (0.5) | G-8 (1) |
| A33 | A19 | — | — | 300° C. | SG-1 (0.5) | G-8 (1) |

For the toner base, the compositions before the external addition treatment described in Table 10 are shown in Table 11. Silica 1 and second external additive 1 are compositions before the surface improvement treatment is performed. Silica 2 and second external additive 2 are compositions after the surface improvement treatment is performed The surface improvement treatment was performed at an amount of raw material supplied of 1 kg/h, a hot air temperature of 200 to 350° C., a hot air volume of 0.35 $Nm^3$/min at a wind pressure of 0.3 MPa, an air volume for raw material dispersion of 0.05 $Nm^3$/min at a wind pressure of 1 $kg/cm^2G$. The ratio of the hot air volume to the air volume for raw material dispersion preferably is 10:1 to 4:1.

The external addition treatment was performed at 2000 $min^{-1}$ for 5 minutes in an amount of an additive introduced of 1 kg with an agitation blade Z0S0 type in FM20B.

The present examples can provide sufficiently good performance in two component development, magnetic single component development, non-magnetic single component development, a contact type, and a non-contact type methods.

In the examples mentioned above, the toners produced by the pulverization were described, but the present invention is not limited thereto and can be applied also to a toner produced in an aqueous medium by the polymerization method.

In the following, it will be explained more specifically. Here, as for the polymerization, the conventional methods known as suspension polymerization, emulsion polymerization, dispersion polymerization or the like can be used. A monomeric system is prepared by adding additives such as a fixing assistant, a colorant and a charge controlling agent in a polymeric monomer, heating until the fixing assistant is dissolved or melted, and dissolving or dispersing it uniformly by a homogenizer, an ultrasonic dispering unit or the like. This monomeric system is dispersed in a water phase of the same temperature as the monomeric system containing a dispersion stabilizer using a common agitation machine or a homomixer-homogenizer etc.

It is preferable that the speed and the time for agitation is controlled such that the monomeric drop has a predetermined toner particle size generally of not more than 20 $\mu$m, and then, the agitation may be performed to the extent that the particle condition is maintained due to the effect of the dispersion stabilizer, and the precipitation of the particles is prevented. The polymerization temperature is determined to be not less than 40° C., generally in a range of 50 to 80° C.

At this time, also for achieving a high dispersion of the fixing assistant and a distribution of toner particles containing the fixing assistant with a small and uniform particle size, the stirring speed preferably is 30 m per second or higher.

When the reaction is over, the produced toner particles are cleaned, collected by filtration and dried. In the suspension polymerization, it is preferable to use normally water comprising 300 to 3000 parts by weight per 100 parts by weight of the monomeric system as the dispersion medium.

All the dispersion mediums used here can be used by dispersing any suitable stabilizer in an aqueous phase for use, i.e. examples of organic compounds are sodium salts of polyvinyl alcohol, gelatin, methyl cellulose, methyl hydroxypropyl cellulose, ethyl cellulose and carboxymethyl cellulose, polyacrylic acid and its salt, and starch. As for inorganic compounds, there are tricalcium phosphate, magnesium phosphate, aluminum phosphate, zinc phosphate, calcium carbonate, magnesium carbonate, barium sulfate, calcium sulfate, aluminum hydroxide, magnesium hydroxide, calcium metasilicate, bentonite, silica, alumina or the like.

When using an inorganic compound among the dispersion stabilizers, the inorganic compound concerned may be produced in the aqueous medium in order to obtain finer particles. For example, in the case of calcium phosphate, it is preferable to mix an aqueous solution of sodium phosphate with an aqueous solution of calcium chloride by a high speed agitation.

Furthermore, for achieving a fine dispersion of these stabilizers, a surface-active agent may be used in an amount of 0.001 to 0.1 parts by weight. This will be added for facilitating the intended effect of the above-mentioned dispersion stabilizer, and specific examples thereof are sodium dodecylbenzene sulfate, sodium tetradecyl sulfate, sodium pentadecyl sulfate, sodium octyl sulfate, sodium oleate, sodium laurate acid, potassium stearate, calcium oleate and so forth. Azo-type or diazo-type polymerization initiators can be used as well, for example, 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile.

Example 1

Figure 2:
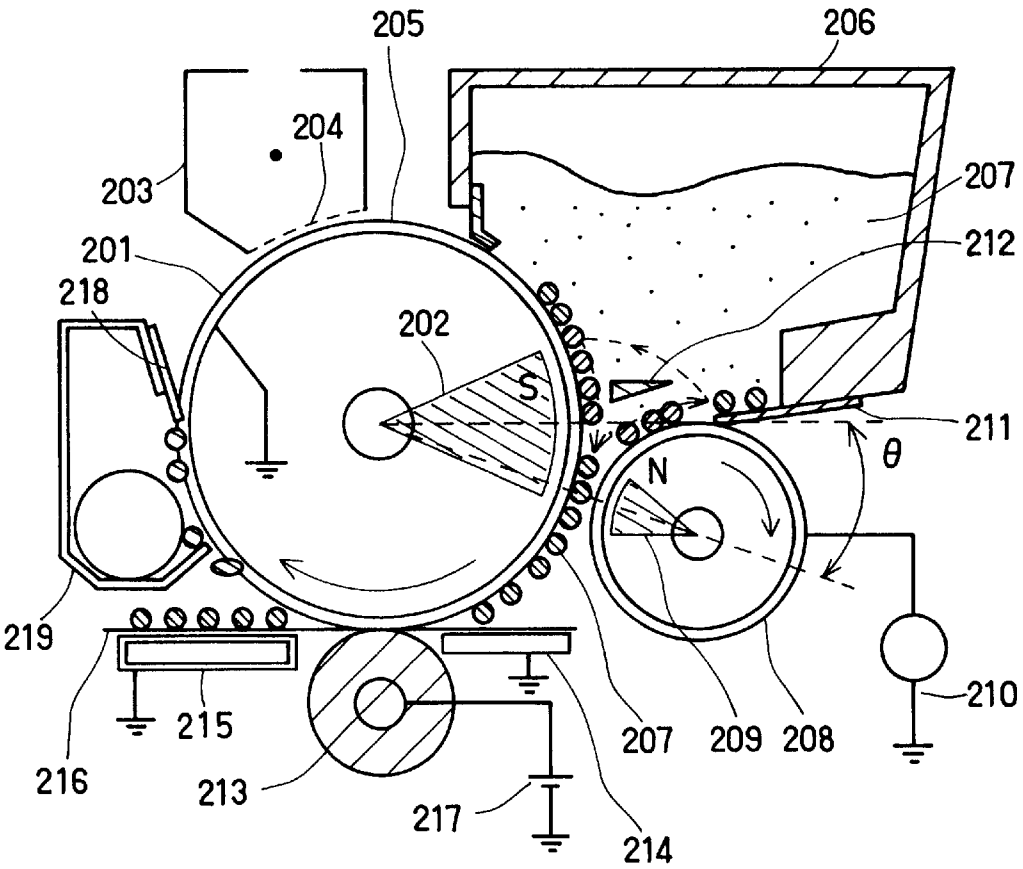
FIG. 2 is a schematic cross-sectional drawing of an electro-photographic apparatus for single component development used in an example of the present invention.

FIG. 2 shows a cross-sectional view of an electrophotographic apparatus used in an example of an electrophotographic method of the present invention. The single component development system was used. Numeral 201 denotes an organic photoconductive member, which was obtained by laminating a charge generation layer and a charge transport layer sequentially on an aluminum conductive support. The charge generation layer includes a polyvinyl butyral resin (Elec BL-1 manufactured by Sekisui Chemical Co., Ltd.) and a charge generation substance of $\tau$ type metal-free phthalocyanine (manufactured by Toyo Ink) that is dispersed in the resin. The charge transport layer includes a polycarbonate resin (Z-200 manufactured by Mitsubishi Gas Chemical) and 1,1-bis(P-diethylaminophenyl)-4,4-diphenyl-1,3-butadiene (T-405 manufactured by Anan Corp.). Numeral 202 denotes a magnet fixed coaxially with the photoconductive member 201, numeral 203 denotes a corona charger for charging the photoconductive member 201 negatively, numeral 204 denotes a grid electrode for controlling the charge potential of the photoconductive member 201, and numeral 205 denotes signal light.

In a development apparatus for forming visible images from latent images after exposure, numeral 207 denotes a magnetic single component toner, numeral 206 denotes a toner hopper for supplying the magnetic toner 207 onto the surface of the photoconductive member 201, numeral 208 denotes a non-magnetic electrode roller spaced away from the photoconductive member 201, numeral 209 denotes a magnet provided inside the electrode roller 208, numeral 210 denotes an alternating high voltage power source for applying voltage to the electrode roller 208, and numeral 211 denotes a scraper made of a polyester film for scraping toner on the electrode roller 208. The electrode roller 208 collects extra toner in a non-image portion on the photoconductive member 201.

Numeral 212 denotes a damper for allowing the toner 207 to flow smoothly in the toner hopper 206 and preventing the toner 207 from being pressed by self-weight thereof so that the toner 207 is not stuck between the photoconductive member 201 and the electrode roller 208.

Numeral 213 denotes a transfer roller for transferring toner images on the photoconductive member to a paper, and provided in such a manner that the surface thereof is contacted with the surface of the photoconductive member 201. The transfer roller 213 is an elastic roller including a conductive metal shaft and a conductive elastic member provided around the shaft. The pressing force applied to the photoconductive member 201 was 0 to 2000 g per transfer roller 213 (about 216 mm), preferably 500 to 1000 g. This was measured with a product of a spring coefficient and a shortened amount of a spring for contacting the transfer roller 213 to the photoconductive member 201. The contact width with the photoconductive member 201 was about 0.5 mm to 5 mm. The rubber hardness of the transfer roller 213 was 80 degree or less, preferably 30 to 40 degrees on the ASKER C scale. The hardness was measured not with a roller but a block piece, measured by an ASKER rubber hardness measuring device (manufactured by Kobunshi Keiki Co., Ltd). The C type indicates a difference in rubber hardness of an object of interest as a displacement degree when a given load is applied. For the elastic roller 213, a shaft having a diameter of 6 mm and expandable urethane elastomer to which a lithium salt such as $Li_2O$ is added internally so that the resistance is $10^7\Omega$ (electrodes are provided on the shaft and the surface, and a voltage of 500V is applied thereto) are used. The outer diameter of the entire transfer roller 213 was 16.4 mm, and the hardness was 40 degrees in the ASKER C. The transfer roller 213 was contacted with the photoconductive member 201 by pressing the shaft of the transfer roller 213 with a metal spring. The pressing force was about 1000 g. As the elastic body for the roller, elastic bodies made of materials other than the expandable urethane elastomer, such as CR rubber, NBR, Si rubber or fluorine rubber, can be used. For the agent for providing electroconductivity, conductive substances other than the lithium salt, such as carbon black, can be used.

Numeral 214 denotes an introduction guide made of a conductive member for guiding a transfer paper to the transfer roller 213, and numeral 215 denotes a conveying guide made of a conductive member whose surface is coated with a insulating material. The introduction guide 214 and the conveying guide 215 are grounded directly or via a resistor. Numeral 216 denotes a transfer paper, numeral 217 denotes a voltage generation power source for applying voltage to the transfer roller 213. Numeral 218 denotes a cleaning rubber elastic blade for scraping toner that has not been transferred, and numeral 219 denotes a cleaning box for storing waste toner.

The magnetic flux density on the surface of the photoconductive member 201 was 600 Gs. The magnetic force inside the electrode roller 208 was made stronger to improve the conveying property. As for the magnet pole angle of the magnets 202 and 209 in the FIG. 2, an angle θ was set at 15 degrees. The diameter of the photoconductive member 201 was 30 mm, and the photoconductive member 201 was rotated at a circumferential speed of 60 mm/s in the direction shown by an arrow in FIG. 2. The diameter of the electrode roller 208 was 16 mm, and the electrode roller 208 was rotated at a circumferential speed of 40 mm/s in the direction opposite to the travel direction of the photoconductive member 201 (the direction shown by an arrow in FIG. 2). The gap between the photoconductive member 201 and the electrode roller 208 was set at 300 $\mu$m.

The photoconductive member 201 was charged by the corona charger 203 (voltage applied was −4.5 kV, the voltage of the grid 4 was −500V) to −500V. The photoconductive member 201 was irradiated with the signal light 205 to form electrostatic latent images. The exposure potential of the photoconductive 201 at this point was −90V. The toner 207 was adhered onto the surface of the photoconductive member 201 by the magnetic attraction force of the magnet 202 in the toner hopper 206. Next, the surface of the photoconductive member 201 passed before the electrode roller 208. When a non-charged region on the photoconductive member 201 passed by, an alternating current voltage (frequency 1 kHz) of $750V_{0-P}$ (1.5 kV in peak to peak) added with a direct current voltage of 0V was applied to the electrode roller 208 by the alternating high voltage power source 210. Thereafter, when the photoconductive member 201 charged to −500V with electrostatic latent images written passed by, an alternating current voltage (frequency 1 kHz) of $750V_{0-P}$ (1.5 kV in peak to peak) added with a direct current voltage of −350V was applied to the electrode roller 208 by the alternating high voltage power source 210. The toner 207 adhered to the non-image portion in the charged portion of the photoconductive member 201 was collected by the electrode roller 208, and toner images with negative and positive reversed were left on the photoconductive member 201. The toner adhered to the electrode roller 208 that rotated in the direction shown by the arrow was scraped by the scraper 211, and returned to the toner hopper 206 so as to be used for the next image formation. The toner images obtained on the photoconductive member 201 in this manner were transferred onto a transfer paper 216 with the transfer roller 213, and fixed thermally by a fixing device (not shown) so as to obtain copied images.

Table 12 shows the results of image tests.

TABLE 12

| Toner | Filming on photoconductive member | Image density (ID) early stage/ after 10000 copies | | Fog | Fog under high humidity | ID under low temperature early stage/ after 1000 copies | |
|---|---|---|---|---|---|---|---|
| A1 | not occurred | 1.40 | 1.37 | G | G | 1.38 | 1.33 |
| A2 | not occurred | 1.36 | 1.34 | G | G | 1.34 | 1.30 |
| A3 | not occurred | 1.36 | 1.34 | G | G | 1.32 | 1.29 |
| A4 | not occurred | 1.34 | 1.31 | G | G | 1.31 | 1.28 |
| A5 | not occurred | 1.38 | 1.36 | G | G | 1.35 | 1.35 |
| A6 | not occurred | 1.34 | 1.32 | G | G | 1.32 | 1.30 |
| A22 | not occurred | 1.38 | 1.36 | G | G | 1.35 | 1.33 |
| A23 | not occurred | 1.34 | 1.36 | G | G | 1.30 | 1.28 |
| A24 | not occurred | 1.36 | 1.35 | G | G | 1.35 | 1.32 |
| J1 | occurred | 1.22 | 1.08 | N | N | 1.19 | 1.05 |

The image evaluation was performed with respect to the image density and background fog by comparing images formed on an early stage and images after a test for durability after 10,000 copies. The background fog was determined visually. A sample without any practical problem is shown with "G" in Table 12, and a sample with a practical problem is shown with "N". Thereafter, the apparatuses were left under high humidity and under low humidity, then an image test for 1000 copies was performed, and the increase in fog and the decrease in the image density were observed.

In toner sample A, there was no disturbance in horizontal lines, no scattering of toner, no poor transfer, no contamination on the reverse face of the paper, and no thinning in letters. Entirely black images were uniform, and high density images having an image density of 1.3 or more were obtained. No background fog was present in the non-image portion. When a long period copy test after 10,000 copies was performed, no filming on the surface of the photoconductive member was present, and copied images with high density and low background fog that were comparable to those formed in an early stage were obtained. There was no fog under high humidity, or no decrease in the density under low humidity.

However, in toner sample J, there was a decrease in the image density, and fog was observed significantly under high humidity, and there was a sharp decrease in the density under low humidity.

Example 2

Figure 3:
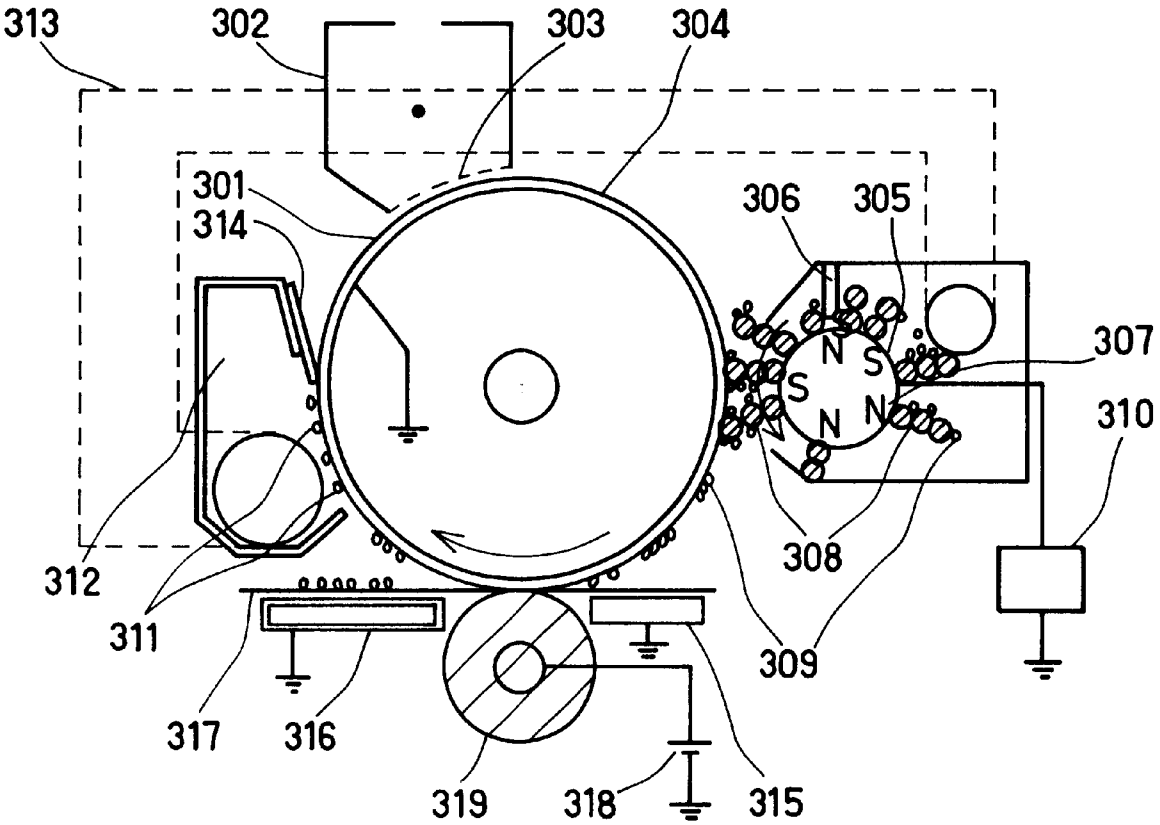
FIG. 3 is a schematic cross-sectional drawing of an electro-photographic apparatus used in the examples of the present invention.

FIG. 3 shows a cross-sectional view of an electrophotographic apparatus used in this example. The apparatus in this example was obtained by modifying a FP7742 (manufactured by Matsushita Electric Industrial Co., Ltd.) copier to an apparatus for a reverse development and providing a waste toner recycle mechanism thereto.

Numeral 301 denotes an organic photoconductive member, which was obtained by laminating a charge generation layer and a charge transport layer sequentially on an aluminum conductive support. The charge generation layer was formed by depositing oxotitanium phthalocyanine powder on the aluminum conductive support. The charge transport layer included a polycarbonate resin (Z-200 manufactured by Mitsubishi Gas Chemical) and a mixture of butadiene and hydrazone. Numeral 302 denotes a corona charger for charging the photoconductive member negatively, numeral 303 denotes a grid electrode for controlling the charge potential of the photoconductive member, and numeral 304 denotes signal light. Numeral 305 denotes a development sleeve, numeral 306 denotes a doctor blade, numeral 307 denotes a magnet roll for retaining carriers, numeral 308 denotes carriers, numeral 309 denotes a toner, numeral 310 denotes a voltage generator, numeral 311 denotes waste toner left from transfer, numeral 312 denotes a cleaning box, and numeral 313 denotes a transport tube for returning the waster toner 311 in the cleaning box 312 to the development process. The toner left from transfer is scraped by the cleaning blade 314, and the waste toner 311 stored in the cleaning box 312 temporarily is returned to the development process through the transport tube 313.

Numeral 319 denotes a transfer roller for transferring toner images on the photoconductive member to a paper, which is provided in such a manner that the surface thereof is in contact with the surface of the photoconductive member 301. The transfer roller 319 is an elastic roller including a conductive metal shaft and a conductive elastic member provided around the shaft. The basic conditions are the same as in Example 1.

Numeral 315 denotes an introduction guide made of a conductive member for guiding a transfer paper to the transfer roller 319, and numeral 316 denotes a conveying guide made of a conductive member whose surface is coated with an insulating material. The introduction guide 315 and the conveying guide 316 are grounded directly or via a resistor. Numeral 317 denotes a transfer paper, and numeral 318 denotes a voltage generation power source for applying voltage to the transfer roller 319.

Table 13 shows the results of image tests.

TABLE 13

| Toner/ carrier | Filming on photoconductive member | Image density (ID) early stage/ after test | | Fog | Fog under high humidity | ID under low humidity early stage/ after 5000 copies | | Transfer thinning |
|---|---|---|---|---|---|---|---|---|
| A7/C1 | not occurred | 1.35 | 1.32 | G | G | 1.32 | 1.29 | None |
| A8/C2 | not occurred | 1.34 | 1.31 | G | G | 1.32 | 1.31 | None |
| A9/C3 | not occurred | 1.38 | 1.35 | G | G | 1.34 | 1.32 | None |

TABLE 13-continued

| Toner/ carrier | Filming on photoconductive member | Image density (ID) early stage/ after test | | Fog | Fog under high humidity | ID under low humidity early stage/ after 5000 copies | | Transfer thinning |
|---|---|---|---|---|---|---|---|---|
| A10/C1 | not occurred | 1.39 | 1.35 | G | G | 1.36 | 1.33 | None |
| A11/C2 | not occurred | 1.32 | 1.31 | G | G | 1.30 | 1.28 | None |
| A12/C2 | not occurred | 1.35 | 1.32 | G | G | 1.31 | 1.28 | None |
| A13/C3 | not occurred | 1.38 | 1.36 | G | G | 1.35 | 1.32 | None |
| A14/C3 | not occurred | 1.35 | 1.32 | G | G | 1.31 | 1.28 | None |
| A25/C2 | not occurred | 1.39 | 1.36 | G | G | 1.36 | 1.33 | None |
| A26/C2 | not occurred | 1.36 | 1.34 | G | G | 1.32 | 1.30 | None |
| A27/C1 | not occurred | 1.38 | 1.34 | G | G | 1.35 | 1.30 | None |
| A28/C3 | not occurred | 1.39 | 1.34 | G | G | 1.36 | 1.31 | None |
| A29/C3 | not occurred | 1.40 | 1.38 | G | G | 1.38 | 1.36 | None |
| J2/C1 | occurred | 1.22 | 1.14 | N | N | 1.19 | 0.92 | Partly occurred |

The image evaluation was performed with respect to the image density and background fog by comparing images formed on an early stage and images after a test for durability after 200,000 copies. The background fog was determined visually. A sample without any practical problem is shown with "G" in Table 13. Thereafter, the apparatuses were left under high humidity, and then image test for 1000 copies was performed, and an increase in fog was observed. When toner concentration control becomes poor so that toner becomes excessive, fog increases significantly. Therefore, it was observed whether or not fog increased. In a separate experiment, the apparatus was left overnight under high temperature and low humidity, and an image test for 5,000 copies was performed the next day. Table 13 shows the image density after 5,000 copies.

In toner sample A, there was no disturbance in horizontal lines, no scattering of toner, no poor transfer, no contamination on the reverse face of the paper, or no thinning in letters. Entirely black images were uniform, and high density images having an image density of 1.3 or more were obtained. No background fog was present in the non-image portion. When a long term copy test after 200,000 copies was performed, no filming on the surface of the photoconductive member was present, and copied images with high density and low background fog that were comparable to those formed on an early stage were obtained. There was no fog under high humidity, and no decrease in the density under high temperature and low humidity.

However, in toner sample J, there was a decrease in the image density, and toner concentration was excessive so that fog was observed significantly under high humidity, and there was a sharp decrease in the density under high temperature and low humidity.

Using toner sample A, the high temperature offset property at a process rate of 140 mm/sec (low speed) and the fixability property based on a fixing ratio at 450 mm/sec (high speed) were evaluated with a apparatus modified from FP-7750 (Matsushita Electric Industrial Co., Ltd.) and FP-7718 (Matsushita Electric Industrial Co., Ltd.). Table 14 shows the results of an image test.

TABLE 14

| Toner | Fixing ratio (%) | Temperature at high temperature offset occurrence (° C.) | Storage stability test |
|---|---|---|---|
| A7 | 91.2 | 215 | B |
| A8 | 88.5 | 210 | G |
| A9 | 85.2 | 205 | G |
| A10 | 86.2 | 215 | G |
| A11 | 92.2 | 210 | G |
| A12 | 94.5 | 205 | B |

TABLE 14-continued

| Toner | Fixing ratio (%) | Temperature at high temperature offset occurrence (° C.) | Storage stability test |
|---|---|---|---|
| A13 | 83.4 | 220 | G |
| A14 | 87.5 | 215 | G |

Toner sample A had satisfactory performance for practical use in the fixing property at high speed, the anti-high temperature offset property at low speed, and high temperature storage property test.

The acceptance criterion for the fixing ratio was set at 80% or more, and that for the offset property was set at 200° C. or more. The fixing ratio was measured by scrubbing each row of patches having an image density of 1.0±0.2 with a weight of 500 g (diameter of 36 mm) wrapped with Bencot (trademark of Asahi Chemical Industry Co., Ltd.) by ten reciprocal movements, and measuring the image density before and after scrubbing with a Macbeth reflection density meter. The change ratio was defined as the fixing ratio. The samples having a fixing ratio of 80% or more were regarded as being acceptable. In the storage test, the evaluation was based on how hard the samples were after they were allowed to stand at 50° C. for 24 hours. Letter "N" in Table 14 represents that the sample was hardened considerably, which was no good for practical use. Letter "B" represents that the sample was hardened slightly, but there is substantially no problem for practical use. Letter "G" represents that the sample was not substantially hardened.

Example 3

Figure 4:
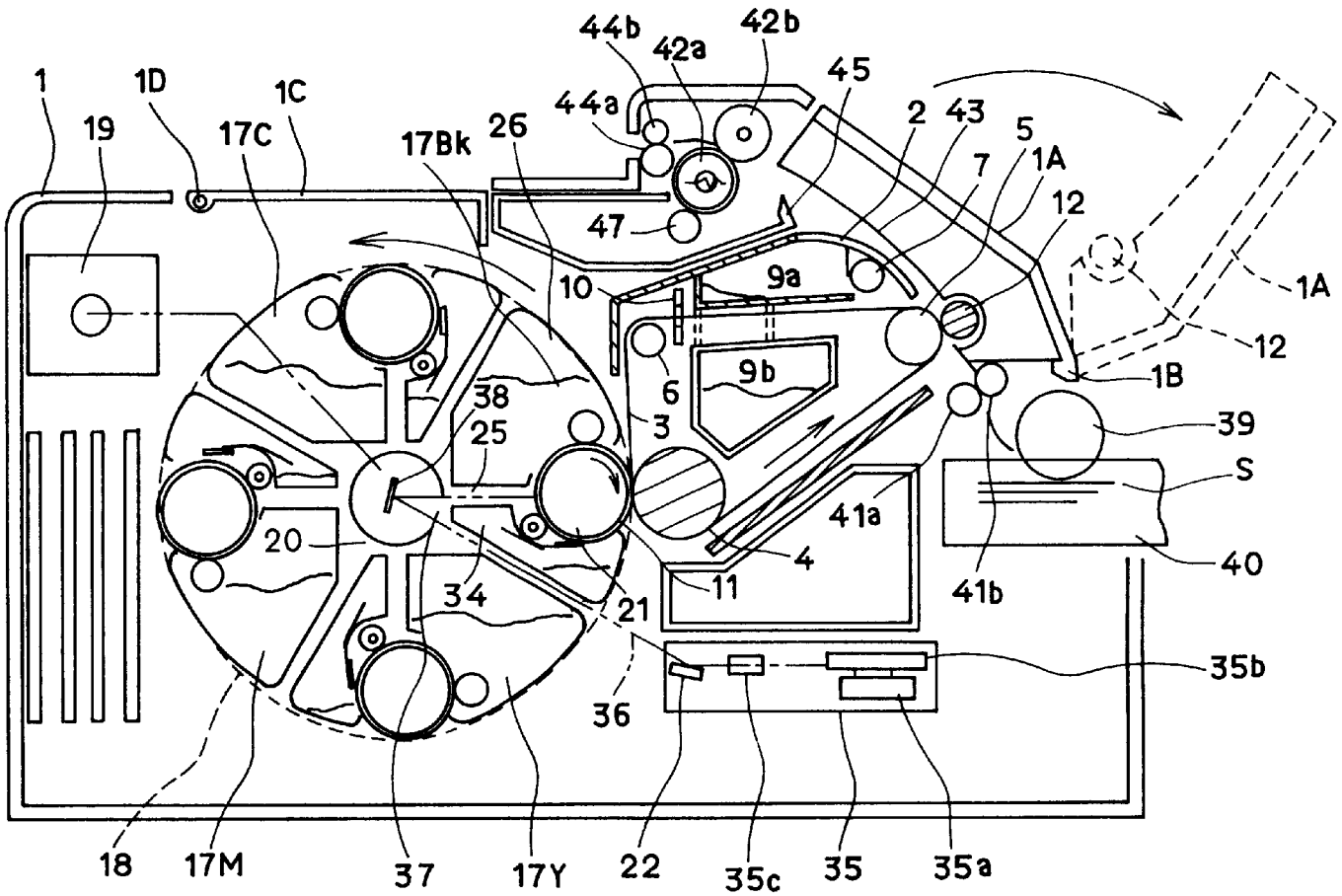
FIG. 4 is a schematic cross-sectional drawing of a color electrophotographic apparatus used in an example of the present invention.

FIG. 4 is a cross-sectional drawing of an electrophotographic apparatus for full color image formation used in this example. In FIG. 4, numeral 1 denotes an outer housing of a color electrophotographic printer, and the right hand side is the front thereof. Numeral 1A denotes a printer front board, which can be opened as shown by dotted lines and closed as shown by solid lines with a hinge axis 1B on the lower side with respect to the printer outer housing 1. The front board 1A is opened to expose the inside of the printer to attach or remove an intermediate transfer belt unit 2 or to inspect the printer when a paper is stuck. The intermediate transfer belt unit 2 can be attached or removed in the direction perpendicular to the direction of rotation axis generatrix of the photoconductive member.

Figure 5:
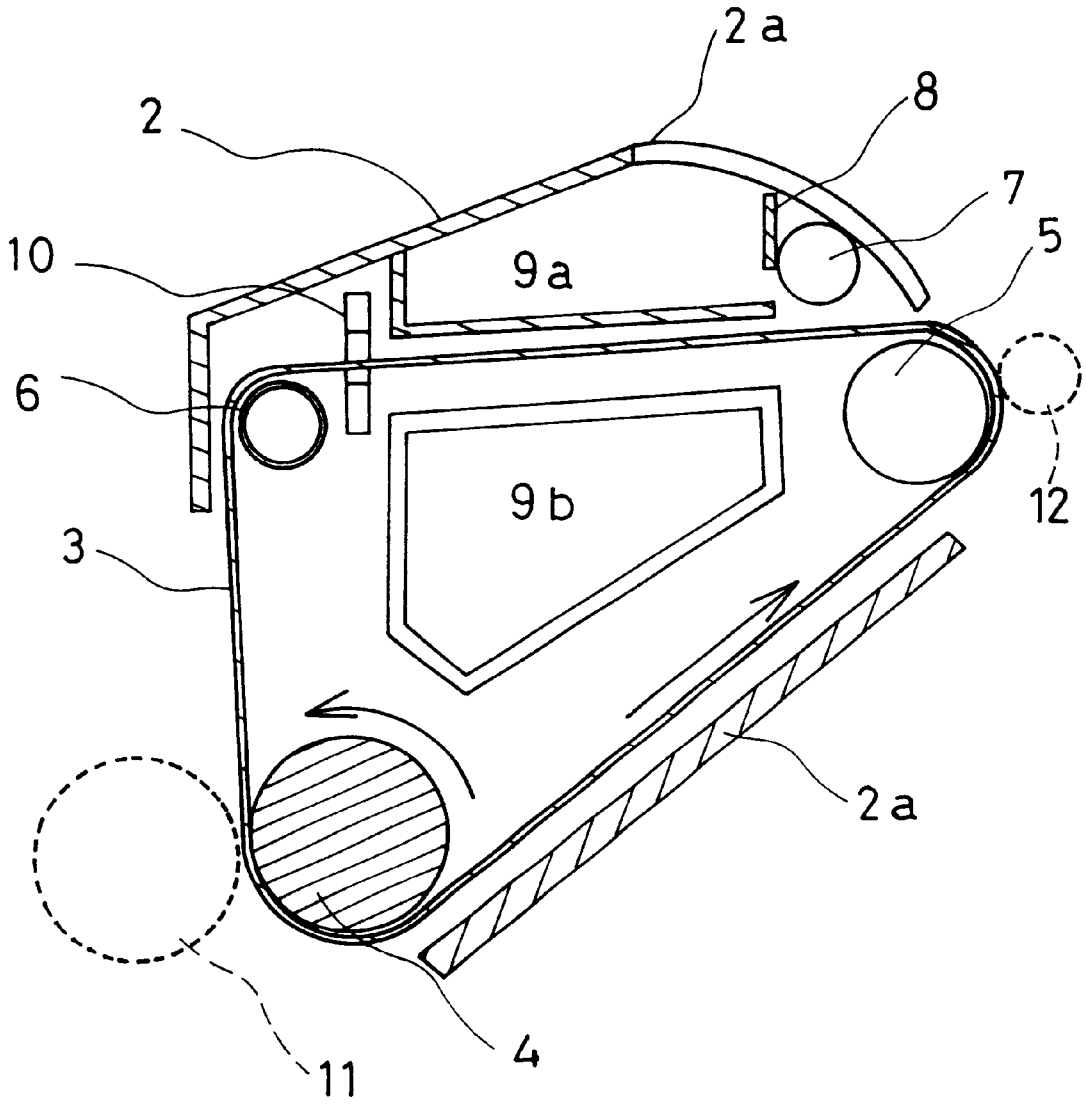
FIG. 5 is a schematic cross-sectional drawing of an intermediate transfer belt unit shown in FIG. 4.

FIG. 5 shows the structure of the intermediate transfer belt unit 2. The intermediate transfer belt unit 2 includes an intermediate transfer belt 3, a first transfer belt roller 4 made of a conductive elastic body, a second transfer belt roller 5 made of aluminum, a tension roller 6 for adjusting the tension of the intermediate transfer belt 3, a belt cleaner roller 7 for cleaning toner images left on the intermediate transfer belt 3, a scraper 8 for scraping toner collected on the cleaner roller 7, waste toner reservoirs 9*a* and 9*b* for storing the collected toner, and a position detector 10 for detecting the position of the intermediate transfer belt 3. As shown in FIG. 4, the intermediate transfer belt unit 2 is attachable and removable with respect to a predetermined receiving portion in the printer outer housing 1 by opening the printer front board 1A as shown by dotted lines.

The intermediate transfer belt 3 can be obtained by kneading a conductive filler in an insulating resin and making a film by an extruder. In this example, a film formed by mixing 95 parts by weight of polycarbonate resin (e.g., European Z300 manufactured by Mitsubishi Gas Kagaku Co., Ltd.) as the insulating resin with 5 parts by weight of a conductive carbon (e.g., "KETJENBLACK" (registered trademark) manufactured by AKZO Co., Ltd.) was used. The surface thereof was coated with a fluorine resin. The thickness of the film was about 350 $\mu$m, and the resistance was about $10^7$ to $10^8$ $\Omega$·cm. The film obtained by extruding the kneaded mixture of the conductive filler and the polycarbonate resin was used as the intermediate transfer belt 3 to prevent slack due to a long period of use of the intermediate transfer belt 3 and accumulation of charges effectively. The surface was coated with a fluorine resin to prevent toner from filming on the surface of the intermediate transfer belt 3 due to a long period of use effectively.

The intermediate transfer belt 3 was wound around the first transfer roller 4, the second transfer roller 5, and the tension roller 6, which were made of endless belt semiconductive urethane based films having a thickness of 100 $\mu$m. In the circumferences thereof, urethane foam treated so as to have a low resistance of $10^7$ $\Omega$·cm was formed. The intermediate transfer belt 3 moved in the direction shown by an arrow. The length of the intermediate transfer belt 3 was 360 mm, which is a result of adding the length (298 mm) in the longitudinal direction of A4 size, which is the largest paper size, and a length (62 mm) slightly more than a half of the circumferential length of a photoconductive drum (diameter of 30 mm) as described later.

When the intermediate transfer belt unit 2 is mounted in the printer body, the first transfer roller 4 is pressed by a force of about 1.0 kg to contact a photoconductive member 11 (see FIG. 5) via the intermediate transfer belt 3, and the second transfer roller 5 is pressed to contact the third transfer roller 12 (see FIG. 5), which has the same configuration as that of the first transfer roller 4, via the intermediate transfer belt 3. The third transfer roller 12 can be rotated in accordance with the movement of the intermediate transfer belt 3.

The cleaner roller 7 is a roller in a belt cleaner portion for cleaning the intermediate transfer belt 3. This operates in such a manner that an alternating current voltage is applied to attract toner to the metal roller electrostatically. This cleaner roller 7 can be replaced by a rubber blade or a conductive fur brush to which voltage is applied.

Referring to FIG. 4, four fan-shaped image formation units 17Bk, 17Y, 17M and 17C for black, cyan, magenta, and yellow, which form an image formation unit group 18, are provided annularly in the center of the printer. Each of the image formation units 17Bk, 17Y, 17M and 17C can be attached to and removed from a predetermined position in the image formation unit group 18 by opening a printer upper board 1C with a hinge axis 1D. The image formation units 17Bk, 17Y, 17M and 17C are mounted in the printer properly so that the mechanical driving systems and the electrical circuit systems on both sides of the image formation units and the printer are connected mechanically and electrically via an inter-coupling member (not shown).

The image formation units 17Bk, 17C, 17M and 17Y are supported by a support (not shown), driven by a moving motor 19 for moving the units as a whole, and are rotatable around a cylindrical shaft 20 that is fixed and not rotated. Each of the image formation unit can be positioned in an image formation portion 21 opposed to the second transfer roller 4 that supports the intermediate transfer belt 3 as described above one after another by a rotation movement. The image formation position 21 is an exposure position by the signal light 22 as well.

Since the image formation units 17Bk, 17C, 17M and 17Y have the same component members except the developers contained therein, for simplification, only the image formation unit 17Bk for black will be described and the rest of the units for other colors will be omitted.

A laser beam scanner portion 35 provided in a lower portion in the printer outer housing 1 includes a semiconductor laser (not shown), a scanner motor 35*a,* a polygon mirror 35*b,* a lens system 35*c* or the like. The pixel laser signal light 22 corresponding to a time series electric pixel signal for pixel information from the laser beam scanner portion 35 passes through an optical path window 36 formed between the image formation units 17Bk and 17Y to be incident on a mirror 38 fixed in the shaft 20 through a window 37, and reflected to travel through an exposure window 25 in the image formation unit 17Bk in the image formation position 21 substantially horizontally. Then, the light passes through a path between a developer reservoir 26 and a cleaner 34 that are provided in the upper and lower portions in the image formation unit, and is incident on an exposure portion on the left side of the photoconductive member 11 so as to perform scanning and exposure in the generatrix direction.

Since a gap between the adjacent image formation units 17Bk and 17Y is utilized as the optical path from the optical path window 36 to the mirror 38, there is substantially no space that is wasted in the image formation unit group 18. Since the mirror 38 is provided in the center of the image formation unit group 18, the mirror can consist of a single fixed mirror, so that the structure is simple and easy for positioning.

The third transfer roller 12 is provided inside the printer front board 1A and above a paper feeding roller 39. A paper conveying path is formed in a nip portion where the intermediate transfer belt 3 and the third transfer roller 12 are contacted so that a paper is fed from the paper feeding roller 39 provided below the printer front board 1A.

A paper feeding cassette 40 protrudes outwardly at a lower side of the printer front board 1A, and a plurality of papers S can be provided simultaneously therein. Numerals 41*a* and 41*b* denote paper conveying timing rollers, numerals 42*a* and 42*b* denote a pair of fixing rollers provided in an upper portion in the printer, numeral 43 denotes a paper guide board provided between the third transfer roller 3 and the pair of fixing rollers 42*a* and 42*b,* numerals 44*a* and 44*b* denote a pair of paper ejecting rollers, numeral 45 denotes a fixing oil reservoir for storing silicone oil 46 to be supplied to the fixing roller 42*a,* and numeral 47 denotes an oil supply roller for applying the silicone oil 46 to the fixing roller 42*a*.

Each of the image formation units 17Bk, 17C, 17M and 17Y and the intermediate transfer belt unit 2 includes a waste toner reservoir.

Hereinafter, the operations will be described.

First, as for the image formation unit group 18, as shown in FIG. 4, the image formation unit 17Bk is positioned in the image formation position 21. The photoconductive member 11 is contacted with the first transfer roller 4 via the intermediate transfer belt 3.

In the image formation process, signal light for black is input to the image formation unit 17Bk by the laser beam scanner portion 35, and images are formed with black toner.

The rate (60 mm/s, which is equal to the circumferential velocity of the photoconductive member) of the image formation in the image formation unit 17Bk is set to be the same rate of the movement of the intermediate transfer belt 3, and upon the image formation, black toner images are transferred to the intermediate transfer belt 3 by the function of the first transfer roller 4. At this time, a direct current voltage of +1 kV is applied to the first transfer roller. Immediately after the black toner images are all transferred, the image formation units 17Bk, 17C, 17M and 17Y are driven by the moving motor 19 so as to rotate and move together as a whole of the image formation unit group 18 in the direction shown by an arrow in FIG. 4. Exactly 90 degree rotation allows the image formation unit 17C to be positioned in the image formation position 21. During this movement, portions other than the photoconductive member in the image formation unit, such as the toner hopper 26 or the cleaner 34, are positioned inward from the rotating curve of the end of the photoconductive member 11, so that the image formation unit is never contacted with the intermediate transfer belt 3.

After the image formation unit 17C reaches the image formation position 21, in the same manner as above, the laser beam scanner portion 35 inputs signal light 22 with signals for cyan to the image formation unit 17C, and toner images are formed and transferred. The intermediate transfer belt 3 has rotated once by this point, and the timing at which the signal light for cyan is written is controlled so that the following toner images for cyan are in registration with the toner images for black that have been transferred previously. During this period, the third transfer roller 12 and the cleaner roller 7 are detached slightly from the intermediate transfer belt 3 so as not to disturb the toner images on the transfer belt.

The same operations as above are performed for magenta and yellow, and color images obtained by superimposing the toner images for the four colors in registration are formed on the intermediate transfer belt 3. After the last transfer of yellow toner images, the toner images for the four colors are transferred collectively on a paper fed by the feeding cassette 40 at matched timing by function of the third transfer roller 12. In this point, the second transfer roller 5 is grounded, and a direct voltage of +1.5 kV is applied to the third transfer roller 12. The toner images transferred on the paper are fixed by the pair of fixing rollers 42*a* and 42*b*. Thereafter, the paper is ejected through the pair of ejecting rollers 44*a* and 44*b* to the outside of the apparatus. Toner that has not been transferred and remains on intermediate transfer belt 3 is cleaned away by the cleaner roller 7 for the next image formation.

Next, the operation in a single color mode will be described. In a single color mode, an image formation unit for a predetermined color moves to the image formation position 21. Then, in the same manner as above, images for the predetermined color are formed and transferred onto the intermediate transfer belt 3. In this case, after transfer, the operation proceeds, and the images are transferred to a paper fed from the feeding cassette 40 by the third transfer roller 12 and fixed.

In this apparatus, the image formation unit can have a structure using a conventional development method.

Using the electrophotographic apparatus of FIG. 4, visual images were formed with the toner samples produced in the manner described above, and there was no disturbance in horizontal lines, no scattering toner, and no thinning in letters. In addition, entirely black images are uniform, significantly high resolution and high quality images that are reproduced at 16 lines per mm were obtained, and high density images having an image density of 1.3 or more were obtained. There was no background fog in the non-image portions. Furthermore, in the long term durability test after 10,000 copies, the fixability and the image density were not changed very much, and the characteristics were stable. In the transfer, there was no problem with thinning for practical use, and the transfer efficiency was 90%. As for the filming of toner (releasing agent) on the photoconductive member or the intermediate transfer belt, there was no problem for practical use.

The transmittance when entirely the same colored images having a density of 0.7 mg/cm$^2$ or more are fixed on an over head projector (OHP) paper at 180° C. with a fixing device without oil and the offset property at high temperature was evaluated. The process rate was 100 mm/sec, and the transmittance was evaluated by measuring the transmittance of light with a spectrophotometer U-3200 (manufactured by Hitachi, Ltd.). With color toners A16 to A21, the transmittance was 90% or more, and the high temperature offset did not occur until 200° C., which are satisfactory results for practical use.

Example 4

177 parts by weight of styrene monomer, 10 parts by weight of copper phthalocyanine pigment, and 4 parts by weight of a charge controlling agent (ditertiarybutyl salicylic acid metal compound) were introduced into a dispersing unit called Attritor and mixed while stirring it for three hours at revolutions of 200 min$^{-1}$ at a temperature of 30° C. in the presence of globular zirconium particles having a diameter of 2 mm. The mixture obtained was transferred to a different container, where 23 parts by weight of n-butylacrylate monomer and 24 parts by weight of jojoba oil fatty acid pentaerythritol monoester (w-3 in Table 4) were added. Then, the mixture was stirred for two hours by using a paddle agitation blade while heating it to 60° C.

The hydrogenated jojoba oil was dissolved in the monomer, and the cyan colorant and the charge controlling agent were dispersed uniformly. Next, the agitation unit was changed to the T. K. Homo Mixer (manufactured by Tokushu Kika Kogyo Co., Ltd.), and 12 parts by weight of a polymerization initiator, 2,2'-azobis-(2,4-dimethylvaleronitrile), was added. The mixture was stirred for one minute at 200 min$^{-1}$ to prepare a polymeric monomer composition. On the other hand, 540 parts by weight of 0.1M—$Na_3PO_4$ aqueous solution was introduced into 710 parts by weight of ion exchanged water, and after it was heated to 60° C., the axis of an agitator was rotated at 50 m per second for stirring using the T. K. Filmics (manufactured by Tokushu Kika Kogyo Co., Ltd.). Then, 80 parts by weight of 1.3M—$CaCl_2$ aqueous solution was added gradually thereto to prepare an aqueous medium containing $Ca_3(PO_4)_2$. The polymeric monomer composition was introduced into the aqueous medium, and the mixture was stirred for 10 minutes at 52 m per second with the T. K. Filmics at 60° C. in an atmosphere of $N_2$ to granulate the polymeric monomer composition. Thereafter, while stirring it with a paddle agitation blade, it was subject to the suspension polymerization for 11 hours at 70° C. to produce a styrene-n-butylacrylate copolymer. When the polymerization reaction was over, it was cooled, and hydrochloric acid was added. After calcium phosphate was dissolved herein, the mixture was filtered, rinsed and dried to obtain a polymer toner. The hydrogenated jojoba oil fatty acid pentaerythritol monoester was included inside the obtained toner. The particle had a weight average particle size of 5.2 $\mu$m.

Visual images were evaluated using the electrophotographic apparatus of FIG. 4. There was no disturbance in horizontal lines, no scattering toner, and no thinning in letters. In addition, entirely black images were uniform, significantly high resolution and high quality images that are reproduced at 16 lines per mm were obtained, and high density images having an image density of 1.3 or more were obtained. There was no background fog in the non-image portions. Furthermore, in the long period durability test after 10,000 copies, the fixability and the image density were not changed very much, and the characteristics were stable. In the transfer, there was no problem with thinning for practical use, and the transfer efficiency was 90%. As for the filming of toner (releasing agent) on the photoconductive member or the intermediate transfer belt, there was no problem for practical use.

The transmittance of the fixability and the offset property at high temperature also were satisfactory results for practical use.

Example 5

170 parts by weight of styrene, 30 parts by weight of 2-ethylhexyl acrylate, and 10 parts by weight of pigment blue 15:3 and 38 parts by weight of maximum hydrogenated meadowfoam oil (w-1 in Table 4) were introduced into a container, where it was heated to 70° C. so as to dissolve the meadowfoam oil, which was then dissolved and dispersed to create a monomer mixture using an ultrasonic dispersing unit (10 KHz, 200 W). Moreover, while maintaining the temperature at 70° C., 10 parts by weight of an initiator "V-601" (manufactured by Wako Pure Chemical Industries, Ltd.) was added and dissolved to prepare a monomer composition. Separately, 10 parts by weight of aerosil #200 (manufactured by Nippon Aerojil) was added to 1200 parts by weight of ion exchanged water. In addition, 2 parts by weight of $NaCO_3$ were mixed. By using the T. K. Filmics (manufactured by Tokushu Kika Kogyo Co., Ltd.) at 70° C., it was dispersed for 15 minutes at 45 m per second to prepare a dispersion medium. The above-mentioned monomer composition was introduced into this medium, and it was stirred for 60 second using the T. K. Filmics (manufactured by Tokushu Kika Kogyo Co., Ltd.) at 70° C. in a nitrogen atmosphere to granulate the monomer composition. When the polymerization was over, sodium hydroxide was added, and the dispersion agent was removed. Then, it was filtered, rinsed out and dried to obtain polymer microparticles.

Visual images were evaluated using the electrophotographic apparatus of FIG. 4. There was no disturbance in horizontal lines, no scattering toner, and no thinning in letters. In addition, entirely black images were uniform, significantly high resolution and high quality images that are reproduced at 16 lines per mm were obtained, and high density images having an image density of 1.3 or more were obtained. There was no background fog in the non-image portions. Furthermore, in the long term durability test after 10,000 copies, the fixability and the image density were not changed very much, and the characteristics were stable. In the transfer, there was no problem with thinning for practical use, and the transfer efficiency was 90%. As for the filming of toner (releasing agent) on the photoconductive member or the intermediate transfer belt, there was no problem for practical use.

The transmittance of the fixablility and the offset property at high temperature also were satisfactory results for practical use.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A toner comprising a toner base and an external additive, the toner base comprising a binder resin, a colorant and a fixing assistant, the fixing assistant includes an ester-based wax having a number average molecular weight Mn of 100 to 5000, a weight average molecular weight Mw of 200 to 10000, Mw/Mn of not more than 8, a heating loss at 220° C. of not more than 8 wt %, an iodine value of not more than 25, and a saponification value of 30 to 300, the toner base is subject to a surface treatment by hot air, and the external additive comprises fine powder of at least one selected from the group consisting of titanium oxide and silica oxide.

2. The toner according to claim 1, wherein at least one selected from the group consisting of titanium oxide and silica oxide is mixed and adhered to the toner base, and then a surface treatment is performed by hot air.

3. A toner obtained by dispersing a monomer containing at least styrene and acrylic acid, a colorant and a fixing assistant in an aqueous medium, preparing a polymeric monomer composition and polymerizing the polymeric monomer composition, wherein the fixing assistant includes an ester-based wax having a number average molecular weight Mn of 100 to 5000, a weight average molecular weight Mw of 200 to 10000, Mw/Mn of not more than 8, a heating loss at 220° C. of not more than 8 wt %, an iodine value of not more than 25, and a saponification value of 30 to 300, and the external additive comprises fine powder of at least one selected from the group consisting of titanium oxide and silica oxide.

4. The toner according to claim 3, wherein the polymeric monomer composition is stirred in the aqueous medium by rotating an axis of an agitator at a rotation speed of at least 30 m per second.

5. The toner according to claim 3, wherein the preparation of the dispersion medium in the aqueous medium and the production of the polymeric monomer composition in the aqueous medium are performed independently.

6. The toner according to claim 3, wherein the dispersion medium is prepared by adding silica fine powder having an average particle size of 8 to 40 nm in an amount of 0.1 to 10 wt % into the aqueous medium.

* * * * *